US008097393B2

(12) United States Patent
Takada et al.

(10) Patent No.: US 8,097,393 B2
(45) Date of Patent: Jan. 17, 2012

(54) IMAGE FORMING APPARATUS AND IMAGE FORMING METHOD

(75) Inventors: Takeshi Takada, Yokohama (JP); Takaaki Ikegami, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 810 days.

(21) Appl. No.: 11/695,750

(22) Filed: Apr. 3, 2007

(65) Prior Publication Data

US 2007/0231733 A1 Oct. 4, 2007

(30) Foreign Application Priority Data

Apr. 4, 2006 (JP) ..... 2006-103293
Jul. 13, 2006 (JP) ..... 2006-193110
Feb. 19, 2007 (JP) ..... 2007-037932

(51) Int. Cl.
*G03G 13/08* (2006.01)

(52) U.S. Cl. ..... 430/123.41; 439/58.75; 439/58.85; 439/123.42; 399/159

(58) Field of Classification Search ..... 430/58.85, 430/123.41, 123.42, 58.75, 73; 399/159
See application file for complete search history.

(56) References Cited

U.S. PATENT DOCUMENTS

| | | | | |
|---|---|---|---|---|
| 4,751,163 | A * | 6/1988 | Hagiwara et al. | 430/58.75 |
| 5,047,803 | A * | 9/1991 | Kanoto | 399/111 |
| 5,549,997 | A * | 8/1996 | Matsushima et al. | 430/58.15 |
| 5,578,405 | A | 11/1996 | Ikegami et al. | |
| 5,604,063 | A * | 2/1997 | Endo et al. | 430/58.4 |
| 5,702,855 | A | 12/1997 | Ikegami et al. | |
| 5,882,813 | A * | 3/1999 | Matsushima et al. | 430/58.45 |
| 6,030,736 | A | 2/2000 | Ikegami et al. | |
| 6,258,499 | B1 * | 7/2001 | Itami | 430/66 |
| 6,485,873 | B1 * | 11/2002 | Ohkura et al. | 430/83 |
| 6,777,149 | B2 | 8/2004 | Ikegami et al. | |
| 6,824,939 | B2 | 11/2004 | Kurimoto et al. | |
| 6,853,823 | B2 | 2/2005 | Sugino et al. | |
| 6,853,834 | B2 | 2/2005 | Kurimoto et al. | |
| 6,861,188 | B2 | 3/2005 | Ikegami et al. | |
| 6,919,155 | B2 * | 7/2005 | Shibata et al. | 430/59.6 |
| 6,946,229 | B2 | 9/2005 | Suzuki et al. | |
| 7,018,755 | B2 | 3/2006 | Ikegami et al. | |
| 7,031,650 | B2 | 4/2006 | Kurimoto et al. | |
| 7,056,635 | B2 | 6/2006 | Tanaka et al. | |
| 7,112,392 | B2 | 9/2006 | Shimada et al. | |
| 7,163,775 | B2 | 1/2007 | Takada et al. | |
| 7,177,583 | B2 | 2/2007 | Kurimoto et al. | |
| 7,767,373 | B2 * | 8/2010 | Goodman et al. | 430/59.6 |
| 7,824,830 | B2 | 11/2010 | Kondo et al. | |
| 2002/0025484 | A1 * | 2/2002 | Takeuchi et al. | 430/78 |
| 2004/0115551 | A1 | 6/2004 | Sugiyama et al. | |
| 2004/0180280 | A1 | 9/2004 | Ikegami et al. | |
| 2004/0265721 | A1 | 12/2004 | Matsuoka et al. | |
| 2005/0008957 | A1 | 1/2005 | Ikegami et al. | |
| 2005/0008961 | A1 | 1/2005 | Takada et al. | |
| 2005/0026058 | A1 | 2/2005 | Kami et al. | |
| 2005/0026066 | A1 | 2/2005 | Tanaka et al. | |
| 2005/0031980 | A1 * | 2/2005 | Inoue et al. | 430/108.22 |
| 2005/0042534 | A1 | 2/2005 | Tanaka et al. | |
| 2005/0053853 | A1 | 3/2005 | Sugino et al. | |
| 2005/0118518 | A1 | 6/2005 | Ikegami et al. | |
| 2005/0130050 | A1 | 6/2005 | Takada et al. | |
| 2005/0201778 | A1 | 9/2005 | Takada et al. | |
| 2006/0141378 | A1 | 6/2006 | Takada et al. | |
| 2006/0199092 | A1 | 9/2006 | Sugino et al. | |
| 2007/0015074 | A1 | 1/2007 | Sugino et al. | |
| 2007/0054209 | A1 * | 3/2007 | Azuma et al. | 430/73 |
| 2007/0059618 | A1 | 3/2007 | Kurimoto et al. | |
| 2007/0059619 | A1 | 3/2007 | Shimoyama et al. | |
| 2007/0117033 | A1 | 5/2007 | Sugino et al. | |
| 2007/0212627 | A1 | 9/2007 | Yanagawa et al. | |
| 2007/0248901 | A1 | 10/2007 | Shimoyama et al. | |
| 2007/0264047 | A1 | 11/2007 | Kurimoto et al. | |
| 2007/0287083 | A1 | 12/2007 | Gondoh et al. | |
| 2007/0297836 | A1 | 12/2007 | Kawasaki et al. | |
| 2008/0112742 | A1 | 5/2008 | Nakamori et al. | |
| 2008/0113286 | A1 | 5/2008 | Shimoyama et al. | |
| 2008/0305426 | A1 | 12/2008 | Kurimoto et al. | |

FOREIGN PATENT DOCUMENTS

| | | |
|---|---|---|
| EP | 1 615 080 A1 | 1/2006 |
| JP | 60-175052 | 9/1985 |
| JP | 06-011878 | 1/1994 |
| JP | 06-317916 | 11/1994 |
| JP | 09-146301 | 6/1997 |
| JP | 2000-81757 | 3/2000 |
| JP | 2000-298365 | 10/2000 |

(Continued)

OTHER PUBLICATIONS

Japanese Patent Office machine-assisted translation of JP 2006-343658 (pub. Dec. 2006).*

(Continued)

*Primary Examiner* — Janis L Dote

(74) *Attorney, Agent, or Firm* — Oblon, Spivak, McClelland, Maier & Neustadt, L.L.P.

(57) ABSTRACT

An image forming apparatus at least containing an electrophotographic photoconductor, a latent electrostatic image forming unit, a developing unit, a transferring unit, and a fixing unit, wherein a glass transition temperature of an outermost layer of the electrophotographic photoconductor is 100° C. or more, wherein the toner is obtained by dissolving and/or dispersing the toner material containing at least an active hydrogen group-containing compound and a polymer reactive with the active hydrogen group-containing compound in an organic solvent to form a solution and/or a dispersion, emulsifying and/or dispersing the solution and/or the dispersion in an aqueous medium containing resin fine particles, allowing the active hydrogen group-containing compound and the polymer reactive with the active hydrogen group-containing compound to react in the aqueous medium, and removing the organic solvent, wherein a glass transition temperature of the resin fine particles is 65° C. to 85° C.

7 Claims, 3 Drawing Sheets

FOREIGN PATENT DOCUMENTS

| | | | |
|---|---|---|---|
| JP | 2001-330972 | | 11/2001 |
| JP | 2002-072522 | | 3/2002 |
| JP | 2002-351113 | | 12/2002 |
| JP | 2004-021194 | | 1/2004 |
| JP | 2005-37562 | | 2/2005 |
| JP | 2005-055498 | | 3/2005 |
| JP | 3682119 | | 5/2005 |
| JP | 2005-234410 | | 9/2005 |
| JP | 2006-343658 | * | 12/2006 |

OTHER PUBLICATIONS

Grant, R., et al., ed., Grant & Hackh' s Chemical Dictionary, Fifth Edition, McGraw-Hill Book Company, NY (1987), pp. 80, 438, 558, 596, and 635.*

U.S. Appl. No. 12/030,886, filed Feb. 14, 2008 Toda, et al.

U.S. Appl. No. 11/868,618, filed Oct. 8, 2007 Sugiyama, et al.

Japanese Office Action dated Jun. 28, 2011, issued in Japanese Patent Application No. 2007-037932.

* cited by examiner

IMAGE FORMING APPARATUS AND IMAGE FORMING METHOD

BACKGROUND OF THE INVENTION

1. Field of the Invention

The present invention relates to an image forming apparatus and an image forming method, which impart an excellent toner transferring ability, thus a residual toner after transferring, which is a cause for fog, can be significantly reduced, and a high quality image can be formed without causing fog even after long term use.

2. Description of the Related Art

In recent years, developments of information processing system employing electrophotography are remarkable. Particularly, a laser printer and a digital copier by which information is converted to digital signals to be recorded by light have been significantly improved in terms of printing quality and reliability. These have been applied to a full-color laser printer and digital copier in combination with high speed technology. Consequently, it is required to obtain higher image quality and higher durability concurrently in the image forming apparatus and image forming method at low cost.

Particularly, a polymerized toner having a small particle diameter has been used to obtain the higher image quality. It is difficult to clean the residual toner after transferring when the polymerized toner having a small particle diameter, and spherical shaped is used. As the measures for these, for example, Japanese Patent Application Laid-Open (JP-A) No. 2005-037562 discloses that a fluorine resin particles are added to the surface of an electrophotographic photoconductor (herein after may be referred to as "photoconductor", "latent electrostatic image bearing member", or "image bearing member") as a lubricating component to reduce the surface energy and increase tone transferring ability, thereby increasing the cleaning property of the residual toner after transferring. However, there are some problems such as the toner transferring ability, maintenance of the cleaning property, and increase of the production cost in the proposal disclosed in JP-A No. 2005-037562. Further improvement and development are desired at present.

BRIEF SUMMARY OF THE INVENTION

The object of the present invention is to provide an image forming apparatus and image forming method, which impart an excellent toner transferring ability, thus a residual toner after transferring, which is a cause for fog, can be significantly reduced, and a high quality image can be formed without causing fog even after long term use.

After intensive investigations to solve the problems, the present inventors have found that the toner transferring ability to a recording medium may be improved when a glass transition temperature of resin fine particles of a toner surface, and a glass transition temperature of an outermost layer in an electrophotographic photoconductor satisfy a certain condition, and the residual toner after transferring, which is a cause for fog, can be significantly reduced and an excellent image quality can be maintained without causing fog even after long term use.

The present invention is based on the above findings by the inventors, and the means for solving the problems are as follows:

<1> An image forming apparatus containing at least an electrophotographic photoconductor, a latent electrostatic image forming unit configured to form a latent electrostatic image on the electrophotographic photoconductor, a developing unit configured to develop the latent electrostatic image using a toner to form a visible image, a transferring unit configured to transfer the visible image to a recording medium, and a fixing unit configured to fix the transferred image on the recording medium, wherein a glass transition temperature of an outermost layer of the electrophotographic photoconductor is 100° C. or more, wherein the toner is obtained by at least one of dissolving and dispersing the toner material containing at least an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein a glass transition temperature of the resin fine particles is 65° C. to 85° C.

<2> The image forming apparatus according to <1>, wherein the outermost layer of the electrophotographic photoconductor contains a compound expressed by the Structural Formula (1):

Structural Formula (1)

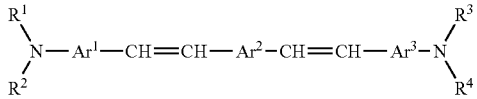

wherein, $R^1$, $R^2$, $R^3$ and $R^4$ may be identical to each other or different, and represent any one of an alkyl group which may be substituted, and an aryl group which may be substituted. $Ar^1$ and $Ar^3$ may be identical to each other or different, and represent an aryl group which may be substituted. $Ar^2$ represents any one of a divalent heterocyclic group which may be substituted, and a divalent aromatic hydrocarbon group which may be substituted.

<3> The image forming apparatus according to any of <1> to <2>, wherein the outermost layer of the electrophotographic photoconductor contains a compound expressed by the Structural Formula (2):

Structural Formula (2)

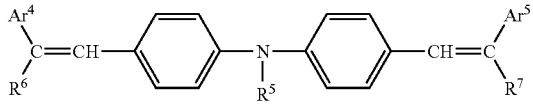

wherein, $R^5$ represents any one of an alkyl group which may be substituted, and an aryl group which may be substituted. $R^6$ and $R^7$ may be identical to each other or different, and represent any one of a hydrogen atom, an alkyl group which may be substituted, and an aryl group which may be substituted. $Ar^4$ and $Ar^5$ may be identical to each other or different, and represent an aryl group which may be substituted.

<4> The image forming apparatus according to any of <1> to <3>, wherein the outermost layer of the electrophotographic photoconductor contains a compound expressed by the Structural Formula (3):

Structural Formula (3)

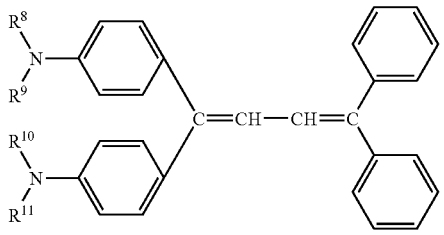

wherein, $R^8$ to $R^{11}$ may be identical to each other or different, and represent an alkyl group which may have an aryl group as a substituent.

<5> The image forming apparatus according to any of <1> to <4>, wherein the electrophotographic photoconductor contains a substrate, and at least a charge generating layer and a charge transporting layer disposed in this order on the substrate, and the charge transporting layer is the outermost layer.

<6> The image forming apparatus according to any of <1> to <5>, wherein a plurality of image forming elements are arranged in tandem, wherein the each of the image forming elements contains at least the electrophotographic photoconductor, a charging unit configured to charge the surface of the electrophotographic photoconductor, the developing unit, and the transferring unit.

<7> The image forming apparatus according to any of claims <1> to <6>, wherein the image forming apparatus contains an intermediate transfer medium to which the visible image formed on the electrophotographic photoconductor is primarily transferred, and the transferring unit configured to secondarily transfer the visible image borne on the intermediate transfer medium to the recording medium, wherein plural colors of toner images are sequentially transferred and superimposed onto the intermediate transfer medium so as to form a color image, and the color image is secondarily transferred onto the recording medium at the same time.

<8> The image forming apparatus according to any of claims <1> to <7>, wherein a process cartridge is detachably attached to the image forming apparatus, wherein the process cartridge contains at least the electrophotographic photoconductor, and the developing unit configured to develop the latent electrostatic image formed on the electrophotographic photoconductor using the toner to form the visible image.

<9> An image forming method contains forming a latent electrostatic image on an electrophotographic photoconductor, developing the latent electrostatic image using a toner to form a visible image, transferring the visible image to a recording medium, and fixing the transferred image on the recording medium, wherein a glass transition temperature of an outermost layer of the electrophotographic photoconductor is 100° C. or more, wherein the toner is obtained by at least one of dissolving and dispersing the toner material containing at least an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein a glass transition temperature of the resin fine particles is 65° C. to 85° C.

<10> The image forming method according to <9>, wherein the outermost layer of the electrophotographic photoconductor contains a compound expressed by the Structural Formula (1):

Structural Formula (1)

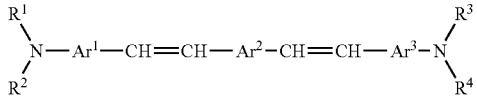

wherein, $R^1$, $R^2$, $R^3$ and $R^4$ may be identical to each other or different, and represent any one of an alkyl group which may be substituted, and an aryl group which may be substituted. $Ar^1$ and $Ar^3$ may be identical to each other or different, and represent an aryl group which may be substituted. $Ar^2$ represents any one of divalent a heterocyclic group which may be substituted, and a divalent aromatic hydrocarbon group which may be substituted.

<11> The image forming method according to any of <9> to <10>, wherein the outermost layer of the electrophotographic photoconductor contains a compound expressed by the Structural Formula (2):

Structural Formula (2)

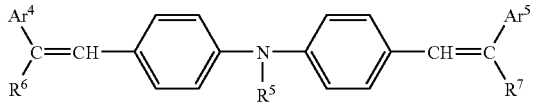

wherein, $R^5$ represents any one of an alkyl group which may be substituted, and an aryl group which may be substituted. $R^6$ and $R^7$ may be identical to each other or different, and represent any one of a hydrogen atom, an alkyl group which may be substituted, and an aryl group which may be substituted. $Ar^4$ and $Ar^5$ may be identical to each other or different, and represent an aryl group which may be substituted.

<12> The image forming method according to any of <9> to <11>, wherein the outermost layer of the electrophotographic photoconductor contains a compound expressed by the Structural Formula (3):

Structural Formula (3)

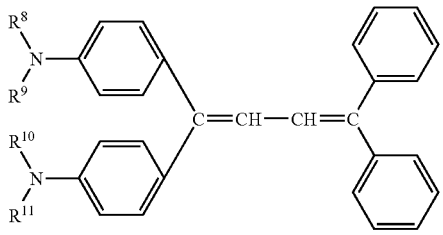

wherein, $R^8$ to $R^{11}$ may be identical to each other or different, and represent an alkyl group which may have an aryl group as a substituent.

<13> The image forming method according to any of <9> to <12>, wherein the electrophotographic photoconductor contains the substrate, and at least a charge generating layer and a charge transporting layer disposed in this order on the substrate, and the charge transporting layer is the outermost layer.

The image forming apparatus of the present invention contains at least the electrophotographic photoconductor, the latent electrostatic image forming unit, the developing unit, the transferring unit, and the fixing unit, wherein the glass transition temperature of the outermost layer in the electrophotographic photoconductor is 100° C. or more, wherein the toner is obtained by at least one of dissolving and dispersing the toner material containing at least an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein the glass transition temperature of the resin fine particles is 65° C. to 85° C.

The image forming apparatus of the present invention has the glass transition temperature of the outermost layer in the electrophotographic photoconductor of 100° C. or more, and the glass transition temperature of the resin fine particle of 65° C. to 85° C., therefore, in the image forming apparatus, the adhesive property of the toner and the outermost layer of the photoconductor may be reduced, and the toner transferring ability to the recording medium may be increased, consequently, the residual toner after transferring can be significantly reduced, and form an excellent image quality without causing fog even after long term use, The image forming method of the present invention contains at least the latent electrostatic image forming step, the developing step, the transferring step, and the fixing step, wherein the glass transition temperature of the outermost layer in the electrophotographic photoconductor is 100° C. or more, wherein the toner is obtained by at least one of dissolving and dispersing the toner material containing at least an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein the glass transition temperature of the resin fine particles is 65° C. to 85° C.

In the image forming method of the present invention, the glass transition temperature of the outermost layer in the electrophotographic photoconductor of 100° C. or more, and the glass transition temperature of the resin fine particle in the toner of 65° C. to 85° C., therefore, the adhesive property of the toner and the outermost layer of the photoconductor may be reduced, and the toner transferring ability to the recording medium may be increased, consequently the residual toner after transferring can be significantly reduced, and form an excellent image quality without causing fog even after long term use,

Figure 1:
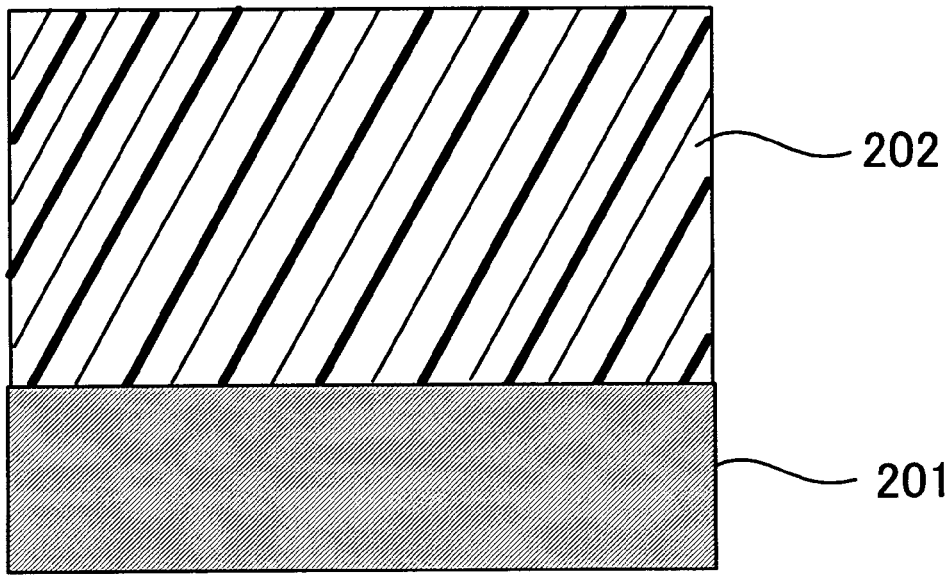
FIG. 1 is a schematic view showing an example of a single-layer electrophotographic photoconductor.

DETAILED DESCRIPTION OF THE INVENTION (Image Forming Apparatus and Image Forming Method)

The image forming apparatus of the present invention contains at least an electrophotographic photoconductor, a latent electrostatic image forming unit, a developing unit, a transferring unit and a fixing unit, and further contains additional units such as a charge eliminating unit, a cleaning unit, a recycling unit and a controlling unit, which are appropriately selected as necessary.

The image forming method of the present invention contains at least a latent electrostatic image forming step, a developing step, a transferring step and a fixing step, and further contains other steps such as a charge eliminating step, a cleaning step, a recycling step and a controlling step, which are appropriately selected as necessary.

The image forming method of the present invention can be preferably performed by the image forming apparatus of the present invention: the latent electrostatic image forming step can be performed by the latent electrostatic image forming unit; the developing step can be performed by the developing unit; the transferring step can be performed by the transferring unit; the fixing step can be performed by the fixing unit; and the other steps can be performed by the other units.

The image forming apparatus contains a plurality of image forming elements which are arranged in tandem, in which the each of the image forming elements contains at least the electrophotographic photoconductor, a charging unit configured to charge the surface of the electrophotographic photoconductor, the developing unit, and the transferring unit.

The image forming apparatus preferably contains an intermediate transfer medium to which a visible image formed on the electrophotographic photoconductor is primarily transferred, and the transferring unit configured to secondarily transfer the visible image borne on the intermediate transfer medium to the recording medium, wherein plural colors of toner images are sequentially transferred and superimposed onto the intermediate transfer medium so as to form a color image, and the color image is secondarily transferred onto the recording medium at the same time.

The image forming apparatus preferably contains a process cartridge containing at least the electrophotographic photoconductor, and the developing unit configured to develop the latent electrostatic image formed on the electrophotographic photoconductor using the toner to form the visible image, wherein the process cartridge is detachably attached to the image forming apparatus.

—Latent Electrostatic Image Forming Step and Latent Electrostatic Image Forming Unit—

The latent electrostatic image forming step is the step of forming the latent electrostatic image on the electrophotographic photoconductor.

<Electrophotographic Photoconductor>

A layer structure in the electrophotographic photoconductor is not particularly limited, and may be appropriately selected depending on the intended purpose. In the first embodiment, the electrophotographic photoconductor contains a photosensitive layer of single layer composition (hereinafter, may be referred to as "single-layer photosensitive layer") on the substrate and further contains other layers such as an undercoat layer as necessary. In the second embodiment, the electrophotographic photoconductor contains the substrate and a photosensitive layer having a multilayer composition, in which a charge generating layer and a charge transporting layer disposed on the substrate (hereinafter, may be referred to as "multilayer photosensitive layer") and further contains other layers such as the undercoat layer as necessary. The charge generating layer and the charge transporting layer may be disposed in reverse order in the second embodiment.

Figure 2:
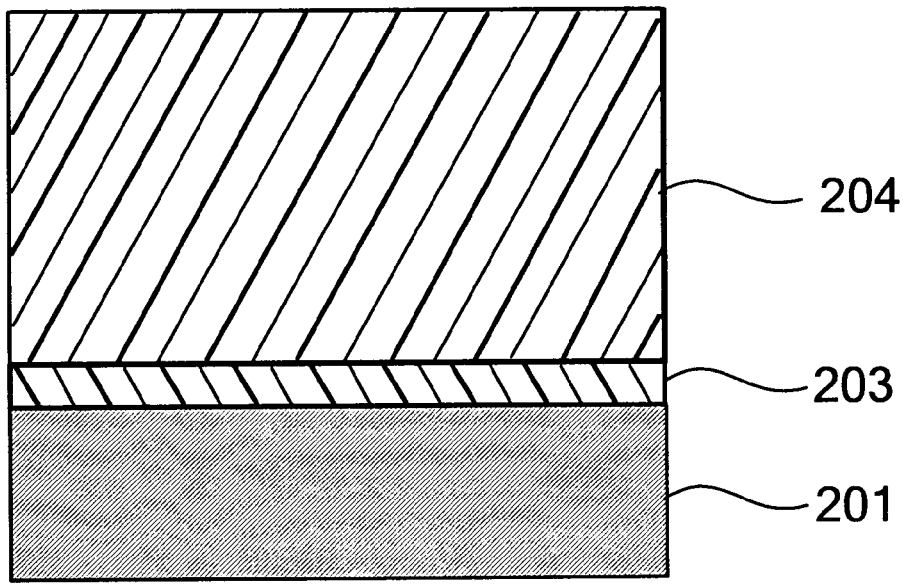
FIG. 2 is a schematic view showing an example of a multilayer electrophotographic photoconductor.

Here, the electrophotographic photoconductor will be explained based on the drawings. FIG. 1 shows an electrophotographic photoconductor having a single-layer photosensitive layer, in which a photosensitive layer 202 containing a charge generating material and charge transporting material as a main composition is disposed on a substrate 201. FIG. 2 shows an electrophotographic photoconductor having a function-separated multilayer photosensitive layer containing a charge generating layer (CGL) 203 and a charge transporting layer (CTL) 204. The other layers and the kinds of the photosensitive layers can be optionally combined as long as the electrophotographic photoconductor of the present invention contains at least the photosensitive layer disposed on the substrate 201. A protective layer may be disposed as an outermost layer of the photoconductor.

—Outermost Layer—

The outermost layer in the multilayer photosensitive layer is, for example, the charge transporting layer and the protective layer. The outermost layer in the single-layer photosensitive layer is, for example, the single-layer photosensitive layer and the protective layer. Of these, it is particularly preferred that the electrophotographic photoconductor contains the substrate, and the charge generating layer and the charge transporting layer which are disposed in this order on the substrate, in which the charge generating layer is the outermost layer.

The glass transition temperature of the outermost layer is 100° C. or more, preferably 100° C. to 200° C., and more preferably 110° C. to 135° C. When the glass transition temperature is less than 100° C., the adhesive property of the toner and the outermost layer may be increased, and the toner transferring ability may be decreased. When the glass transition temperature is more than 200° C., the mutual action among materials of the outermost layer may be stronger, crack may occur.

The glass transition temperature of the outermost layer can be measured as follows:

<Measurement of Glass Transition Temperature of Outermost Layer>

A coating liquid for the outermost layer is blade coated on aluminum deposited polyethylene terephthalate (PET) film, and dried under the drying condition similar to that in the production of the photoconductor so as to form a 2 μm-thick coating film. However, when the drying condition in the production of the photoconductor is more than 130° C., the outermost layer is dried at 130° C. for 1 hour. The thus formed coating film is peeled and about 2 mg of the peeled coating film is weighed in an aluminum sample vessel, and measured using $\alpha$-$Al_2O_3$ as a standard sample by means of Thermo Plus DSC8230 (by Rigaku Denki Co., Ltd.). The sample is heated from a room temperature to 250° C. at a temperature rising rate of 10° C./min to obtain a DSC curve. From the obtained DSC curve, the glass-transition temperature of the outermost layer is determined from an intersection of a tangential line of the endothermic curve and the base line.

The outermost layer contains at least any one of compounds expressed by the following Structural Formula (1), Structural Formula (2), and Structural Formula (3), and further contains other components as necessary.

When the charge transporting layer is the outermost layer, the charge transporting layer preferably contains at least any one of the compounds expressed by the following Structural Formula (1), Structural Formula (2), and Structural Formula (3).

Japanese Patent Application Publication (JP-B) No. 58-57739 discloses the inclusion of the compounds expressed by the following Structural Formula (1) in a charge transporting layer enables to improve a blue sensitivity of a charge generating layer. However, it does not describe that a glass transition temperature of an outermost layer becomes higher, neither discloses nor suggests that a toner transfer rate significantly increases with the relation of a glass transition temperature of resin fine particles in a toner.

Japanese Patent Application Publication (JP-B) No. 5-42611 discloses the inclusion of the compounds expressed by the following Structural Formula (2) in a charge transporting layer leads to an excellent photoconductor characteristics. However, it does not describe that a glass transition temperature of an outermost layer becomes higher, neither discloses nor suggests that a toner transfer rate significantly increases with the relation of a glass transition temperature of resin fine particles in a toner.

Japanese Patent Application Laid-Open (JP-A) No. 9-297413 discloses that a photoconductor which is less liable to optical fatigue, and excellent in mechanical characteristics by including the compound expressed by the following Structural Formula(3) in a charge transporting layer. However, it does not describe that a glass transition temperature of an outermost layer becomes higher, neither discloses nor suggests that a toner transfer rate significantly increases with the relation of a glass transition temperature of resin fine particles in a toner.

Structural Formula (1)

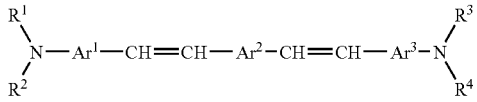

wherein, $R^1$, $R^2$, $R^3$ and $R^4$ may be identical to each other or different, and represent any one of an alkyl group which may be substituted, and an aryl group which may be substituted. $Ar^1$ and $Ar^3$ may be identical to each other or different, and represent an aryl group which may be substituted. $Ar^2$ represents any one of a divalent heterocyclic group which may be substituted, and a divalent aromatic hydrocarbon group which may be substituted.

Structural Formula (2)

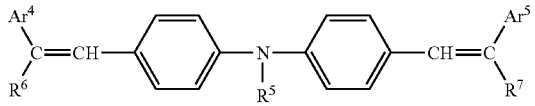

wherein, $R^5$ represents any one of an alkyl group which may be substituted, and an aryl group which may be substituted.

$R^6$ and $R^7$ may be identical to each other or different, and represent any one of a hydrogen atom, an alkyl group which may be substituted, and an aryl group which may be substituted. $Ar^4$ and $Ar^5$ may be identical to each other or different, and represent an aryl group which may be substituted.

Structural Formula (3)

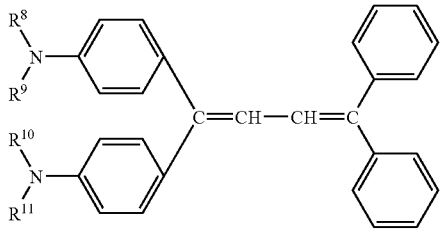

wherein, $R^8$ to $R^{11}$ may be identical to each other or different, and represent an alkyl group which may have an aryl group as a substituent.

In the Structural Formulas (1), (2), and (3), examples of the alkyl groups include a methyl group, an ethyl group, a propyl group, an isopropyl group, a butyl group, an isobutyl group, a sec-butyl group, a tert-butyl group, a pentyl group, an isopentyl group, a neopentyl group, a hexyl group, a heptyl group, an octyl group, a nonyl group, a decyl group, a undecyl group, a dodecyl group, a vinyl group, a benzyl group, a phenethyl group, a styryl group, a cyclopenthyl group, a cyclohexyl group, a cycloheptyl group and a cyclohexenyl group.

In the Structural Formulas (1) and (2), examples of the aryl groups include a phenyl group, a tolyl group, a xylyl group, a styryl group, a naphthyl group, an anthryl group and an and biphenyl group.

In the Structural Formula (1), examples of the divalent aromatic hydrocarbon groups include a phenylene group, a biphenyldiyl group, a terphenyldiyl group, a quaterphenyldiyl group, a quinquephenyldiyl group, a sexiphenyldiyl group, a septiphenyldiyl group, an octiphenyldiyl group, a noviphenyldiyl group, a deciphenyldiyl group, a diphenylmethanediyl group, a diphenylacetylenediyl group, a diphenyletherdiyl group, a diphenylsulfidediyl group, a diphenylsulfondiyl group, a furandiyl group, a thiophenediyl group, a naphthalenediyl group, a fluorenediyl group and a stilbenediyl group.

In the Structural Formula (1), examples of the divalent heterocyclic groups include a 2-furyl group, a 2-thienyl group, a 5-metyl-2-thienyl group, and a 2-pyridyl group.

In the Structural Formulas (1) and (2), examples of the substituents in the alkyl group, aryl group, divalent aromatic hydrocarbon group, and heterocyclic group include an alkoxy group, a carboxyl group, and an ester thereof, a cyano group, an alkylamino group, an aralkylamino group, an amino group, a nitro group, an acetylamino group, and a halogen atom.

In the Structural Formula (3), the alkyl group may have an aryl group as a substituent. Examples of the aryl groups include a phenyl group, a tolyl group, a xylyl group, a styryl group, a naphthyl group, an anthryl group, and a biphenyl group.

The specific examples of the compounds expressed by the Structural Formula (1), which are not limited thereto, are shown as follows:

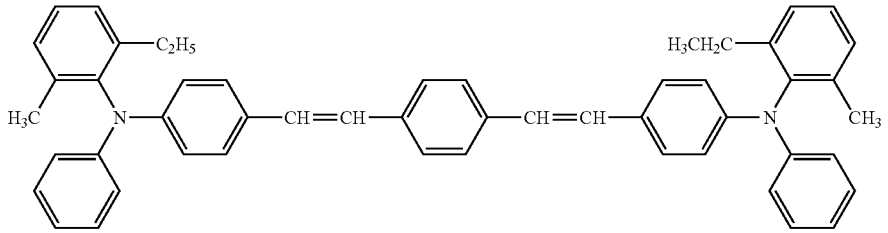

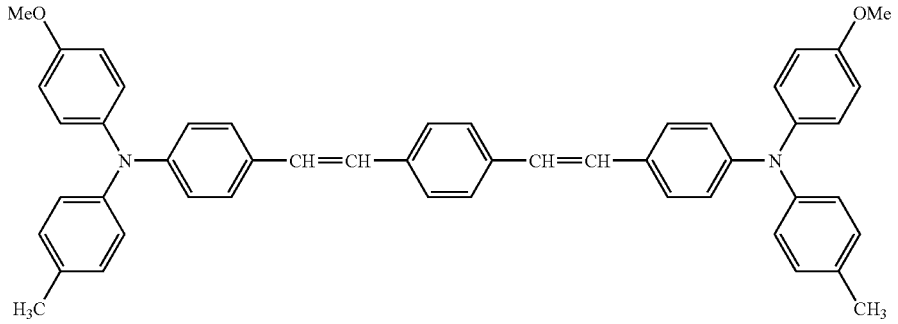

wherein Me represents a methyl group.

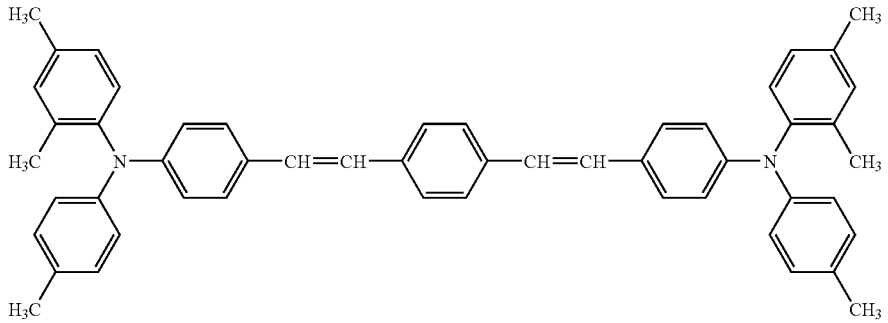

The specific examples of the compounds expressed by the Structural Formula (2), which are not limited thereto, are shown as follows:

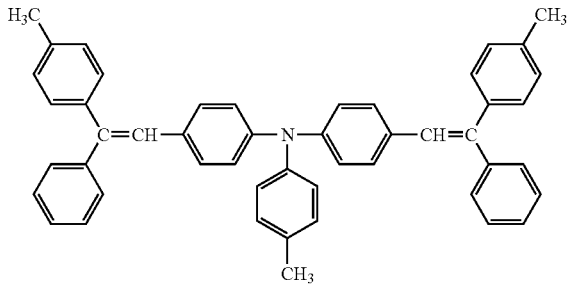

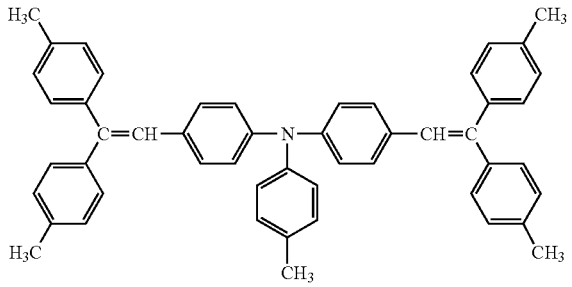

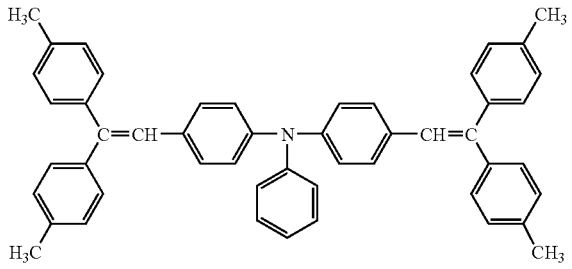

The specific examples of the compounds expressed by the Structural Formula (3), which are not limited thereto, are shown as follows:

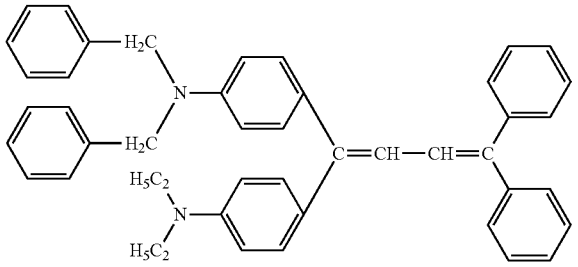

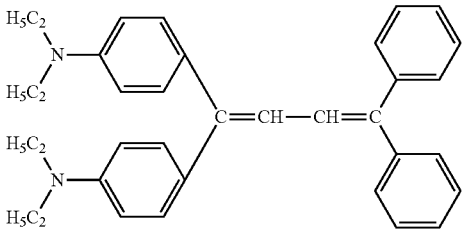

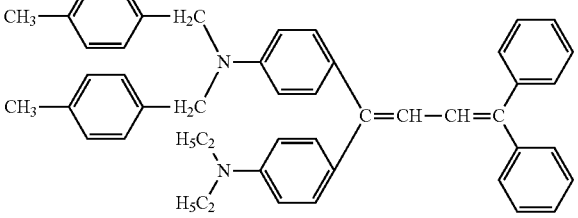

The content of the compounds expressed by the Structural Formulas (1), (2), and (3) in the outermost layer is preferably 10% by mass to 70% by mass, and more preferably 20% by mass to 50% by mass. When the content is less than 10% by mass, the glass transition temperature of the outermost layer may be reduced, and the toner transferring ability may be decreased. When the content is more than 70% by mass, the compounds expressed by the Structural Formulas (1), (2), and (3) may separate out over time.

The compounds expressed by the Structural Formulas (1), (2), and (3) can be used in combination. For example, the mixing mass ratio of the compound expressed by the Structural Formula (1) to the compound expressed by the Structural Formulas (2) or (3) is preferably 10:90 to 90:10, and more preferably 30:70 to 70:30.

—Substrate—

The substrate is not particularly limited and may be appropriately selected depending on the intended purpose, as long as it exhibits electrical conductivity and has a volume resistance of $10^{10}$ Ω·cm or less. Examples of the substrates include: (1) a film-shaped or cylindrical plastic or paper coated with a metal such as aluminum, nickel, chrome, nichrome, copper, gold, silver; and a metal oxide such as tin oxide and indium oxide by vapor deposition or sputtering; (2) a plate of aluminum, aluminum alloy, nickel or stainless steel or tube which is surface-processed by cutting, superfinishing or polishing, etc. after plate of aluminum, aluminum alloy, nickel or stainless steel is formed into a tube by methods such as extrusion or drawing; (3) the endless nickel belt and endless stainless-steel belt disclosed in JP-A No. 52-36016; (4) electrically conductive-processed, for example, aluminum metallizing on the surface of the nickel foil of 50 μm to 150 μm thick or polyethylene terephthalate (PET) film of 50 μm to 150 μm thick.

Alternatively, the substrate coated with a solution in which conductive fine particles and a binder resin are dispersed into a solvent can be used.

The material for the conductive fine particle is not particularly limited and may be appropriately selected depending on the intended purpose. Examples thereof include carbon black, acetylene black; metal powders of aluminum, nickel, iron, nichrome, copper, zinc and silver, etc.; and a metal oxide fine particle such as conductive tin oxide and ITO. These may be used alone or in combination.

The binder resin is not particularly limited, and may be appropriately selected depending on the intended purpose. Examples thereof include a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyacrylate resin, a phenoxy resin, a polycarbonate resin, an acetylcellulose resin, an ethylcellulose resin, a polyvinyl butyral resin, a polyvinyl formal resin, a polyvinyl toluene resin, a poly-N-vinylcarbazole resin, an acylic resin, a silicone resin, an epoxy resin, a melamine resin, a urethane resin, a phenol resin and an alkyd resin. These may be used alone or in combination.

The solvent is not particularly limited, and may be appropriately selected depending on the intended purpose. Examples thereof include tetrahydrofran, dichloromethane, methyl ethyl ketone and toluene.

A conductive layer of a heat contraction tube in which the conductive fine particles are contained in a material disposed on a cylindrical base substance is also preferably used as a conductive substrate. Examples of the materials include a polyvinyl chloride resin, a polypropylene resin, a polyester resin, a polystyrene resin, a polyvinylidene chloride resin, a polyethylene resin, a chlorinated rubber and TEFLON.

—Multilayer Photosensitive Layer—

The multilayer photosensitive layer contains the charge generating layer and the charge transporting layer in this order, and further contains other layers such as the protective layer, and the intermediate layer as necessary.

—Charge Generating Layer—

The charge generating layer contains at least a charge generating material, also a binder resin, and further contains other components as necessary.

The charge generating material is not particularly limited, and may be appropriately selected depending on the intended purpose. Either an inorganic material or an organic material can be used.

The inorganic material is not particularly limited, and may be appropriately selected depending on the intended purpose. Examples thereof include crystalline selenium, amorphous selenium, selenium-tellurium, selenium-tellurium-halogen, and selenium-arsenic compound.

The organic material is not particularly limited, and may be appropriately selected depending on the intended purpose. Examples thereof include C.I. Pigment Blue 25 (Color Index C.I. 21180), C.I. Pigment Red 41 (C.I. 21200), C.I. Acid Red 52 (C.I. 45100), C.I. Basic Red 3 (C.I. 45210), azo pigments such as azo pigments having a carbazole skeleton, azo pigments having a distyrylbenzen skeleton, azo pigments having a triphenylamine skeleton, azo pigments having a dibenzothiophene skeleton, azo pigments having an oxadiazole skeleton, azo pigments having a fluorenone skeleton, azo pigments having a bisstilbene skeleton, azo pigments having a distyryloxadiazole skeleton, azo pigments having a distyrylcarbazole skeleton; phthalocyanine pigment such as C.I. Pigment Blue 16 (C.I. 74100); indigoid pigments such as C.I. Vat Brown (C.I. 73410) and C.I. Vat Dye (C.I. 730.50); perylene pigment such as Algo Scarlet 5 (by Bayer), Indanthrene Scarlet R(by Bayer); and squaric pigment. These may be used alone or in combination.

The binder resin is not particularly limited and may be appropriately selected depending on the intended purpose. Examples thereof include a polyamide resin, a polyurethane resin, an epoxy resin, a polyketone resin, a polycarbonate resin, a silicone resin, an acrylic resin, a polyvinyl butyral resin, a polyvinyl formal resin, a polyvinyl ketone resin, a polystyrene resin, a poly-N-vinylcarbazole resin and a polyacrylamide resin. These may be used alone or in combination.

The charge transporting material may be added as necessary. A high molecular charge transporting materials may be added other than the binder resin as the binder resin for the charge generating layer.

The methods for forming the charge generating layer include a vacuum thin-film forming method and a casting method from solution dispersal system.

Examples of the vacuum thin-film forming methods include glow discharge polymerization, vacuum deposition, CVD, sputtering, reactive sputtering, ion plating and accelerated ion injection. The above-mentioned inorganic material or organic material can be formed appropriately by the vacuum thin-film forming.

Examples of the casting methods include known methods such as dip-coating, spray coating and bead coating.

The organic solvents used for the coating liquid for the charge generating layer is not particularly limited, and may be appropriately selected depending on the intended purpose. Examples thereof include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofran, dioxolan, dioxane, methanol, ethanol, isopropyl alcohol, butanol, ethyl acetate, butyl acetate, dimethylsulfoxide, methyl cellosolve, ethyl cellosolve and propyl cellosolve. These may be used alone or in combination. Of these, the tetrahydrofran having the boiling point of 40° C. to 80° C., the methyl ethyl ketone, the dichloromethane, the methanol, and the ethanol are preferably used due to easy drying after coated.

The coating liquid for the charge generating layer is prepared by dispersing and dissolving the charge generating material and binder resin in the above organic solvent. Examples of the methods for dispersing organic pigments in the organic solvents include a dispersing method using dispersal media such as a ball mill, a bead mill, a sand mill, a vibration mill and a high-speed fluid collision dispersing method.

The thickness of the charge generating layer is not particularly limited and may be adjusted depending on the intended purpose. It is preferably 0.01 μm to 5 μm, and more preferably 0.05 μm to 2 μm.

—Charge Transporting Layer—

The charge transporting layer is designed to maintain a charge, and transfer a charge which is generated and separated from the charge generating layer so as to unite with the maintained charge by exposing. The charge transporting layer is required to have high electrical resistance in order to maintain a charge. Moreover, the charge transporting layer is required to have low dielectric constant and appropriate charge transferring ability in order to obtain high surface potential with the maintained charge.

The charge transporting layer contains at least a charge transporting material. When the charge transporting layer is the outermost layer, it contains at least any one of the compounds expressed by Structural Formulas (1), (2) and (3), also the binder resin, and further contains other components as necessary.

As the charge transporting material, low-molecular charge transporting material such as a hole transporting substance, an electron transporting substance is used, and a high molecular charge transporting material can be further added as necessary.

Examples of the electron transporting substances (acceptor) include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on and 1,3,7-trinitrodibenzothiophene-5,5-dioxide. These charge transporting materials may be used alone or in combination.

Examples of the hole transporting substances (donor) include oxazole derivative, oxadiazole derivative, imidazole derivative, triphenylamine derivative, 9-(p-diethylaminostyryl anthracene), 1,1-bis-(4-dibenzylaminophenyl)propane, styryl anthracene, styrylpyrazoline, phenylhydrazones, α-phenylstilbene derivative, thiazole derivative, triazole derivative, phenazine derivative, acridine derivative, benzofuran derivative, benzimidazole derivative and thiophene derivative. These may be used alone or in combination.

Examples of the high molecular charge transporting materials include the materials have the following structures:

(A) Polymers Having Carbazole Ring

Examples of such polymers include poly-N-vinyl carbazole, and compounds disclosed in JP-A Nos. 50-82056, 54-9632, 54-11737, 4-175337, 4-183719 and 6-234841.

(B) Polymers Having Hydrazone Structure

Examples of such polymers include compounds disclosed in JP-A Nos. 57-78402, 61-20953, 61-296358, 1-134456, 1-179164, 3-180851, 3-180852, 3-50555, 5-310904 and 6-234840.

(C) Polysilylene Polymers

Examples of such polymers include the compounds disclosed in JP-A Nos. 63-285552, 1-88461, 4-264130, 4-264131, 4-264132, 4-264133 and 4-289867.

(D) Polymers Having Triaryl Amine Structure

Examples of such polymers include N,N-bis(4-methylphenyl)-4-aminopolystyrene, and compounds disclosed in JP-A Nos. 1-134457, 2-282264, 2-304456, 4-133065, 4-133066, 5-40350 and 5-202135.

(E) Other Polymers

Examples of such polymers include condensation products of nitropyrene with formaldehyde, and compounds disclosed in JP-A Nos. 51-73888, 56-150749, 6-234836 and 6-234837.

In addition, examples of the high molecular charge transporting materials include polycarbonates, polyurethanes, polyesters and polyethers, which have a triaryl amine structure. Specific examples thereof include compounds disclosed in JP-A Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

The high molecular charge transporting materials having an electron donating group are not limited to the above polymers, and a known copolymer such as a copolymer of the known monomers, a block polymer, a graft polymer, and a star polymer may also be used. In addition, a crosslinking polymer having an electron donating group disclosed in, for example, JP-A No. 3-109406 may also be used.

The binder resin is not particularly limited, and may be appropriately selected depending on the intended purpose. Examples thereof include a polycarbonate resin, a polyester resin, a methacrylic resin, an acrylic resin, a polyethylene resin, a polyvinyl chloride resin, a polyvinyl acetate resin, a polystyrene resin, a phenol resin, an epoxy resin, a polyurethane resin, a polyvinylidene chloride resin, an alkyd resin, a silicon resin, a polyvinyl carbazole resin, a polyvinyl butyral resin, a polyvinyl formal resin, a polyacrylate resin, a polyacrylamide resin and a phenoxy resin. These may be used alone or in combination.

The charge transporting layer may contain a copolymer of a cross-linkable binder resin and a cross-linkable charge transporting material.

The content of the charge transporting material in the charge transporting layer is preferably 30% by mass or more, and more preferably 40% by mass or more based on the charge transporting layer. When the content of the charge transporting material is less than 30% by mass, it sometimes fails to obtain a sufficient light attenuation time in a high-speed electrographic process, where pulse light exposure is performed to expose a photoconductor to laser light for recording.

The carrier mobility of the charge transporting layer in the electrophotographic photoconductor is preferably $3\times10^{-5}$ $cm^2/V\cdot s$ or more, and more preferably $7\times10^{-5}$ $cm^2/V\cdot s$ or more under the condition of the electrical field strength in the range of $2.5\times10^5$ V/cm to $5.5\times10^5$ V/cm in the charge transporting layer. The carrier mobility of the charge transporting layer may be adjusted accordingly to attain the above carrier mobility under the use condition. The carrier mobility can be determined with the known Time-of-Flight Method.

The charge transporting layer can be formed by coating and drying a liquid in which the charge transporting material and the binder resin are dissolved and/or dispersed in an appropriate solvent. Additive agents such as a plasticizer, a antioxidant and a leveling agent may be added to the charge transporting layer in an appropriate amount accordingly, other than the charge transporting material and the binder resin.

The thickness of the charge transporting layer is not particularly limited, and may be appropriately selected depending on the intended purpose. It is preferably 5 μm to 30 μm.

—Single-Layer Photosensitive Layer—

The single-layer photosensitive layer contains the charge generating material, the charge transporting material, and the binder resin, and further contains other components as necessary.

The above-mentioned materials can be used for the charge generating material, the charge transporting material, and the binder resin. Examples of the other components include a plasticizer, a fine particle, and various additives.

When the single-layer photosensitive layer is the outermost layer, the single-layer photosensitive layer contains at least any one of the compounds expressed by Structural Formulas (1), (2) and (3).

The thickness of the single-layer photosensitive layer is not particularly limited, and may be appropriately selected depending on the intended purpose. It is preferably 5 μm to 100 μm, and more preferably 5 μm to 50 μm. When the thickness of the single-layer photosensitive layer is less than 5 μm, the charge property may be reduced. When the thickness of the single-layer photosensitive layer is more than 100 μm, the sensitivity may be reduced.

—Protective Layer—

In the electrophotographic photoconductor, the protective layer containing a filler may be disposed on the photosensitive layer in order to protect the photosensitive layer and improve the durability of the photosensitive layer as the outermost layer. When the protective layer is disposed, the protective layer preferably contains at least any one of the compounds expressed by the Structural Formulas (1), Structural Formula (2) and Structural Formula (3).

The protective layer contains the binder resin and the filler other than the above-mentioned compounds, and further contains other components as necessary.

Examples of the binder resins used for the protective layer include a ABS resin, a ACS resin, a AS resin, an olefin-vinyl monomer copolymer, a chlorinated polyether resin, an allyl resin, a phenol resin, a polyacetal resin, a polyamide resin, a polyamide-imide resin, a polyacrylate resin, a polyaryl sulfonate resin, a polybutylene resin, a polybutylene terephthalate resin, a polycarbonate resin, a polyether sulfone resin, a polyethylene resin, a polyethylene terephthalate resin, a polyimide resin, an acrylic resin, a polymethylpentene resin, a polypropylene resin, a polyphenylene oxide resin, a polysulfone resin, a polyurethane resin, a polyvinyl chloride resin, a polyvinylidene chloride resin, and an epoxy resin.

It is effective to add the filler into the protective layer in order to improve wear resistance. Examples of the fillers include fine powders of organic materials such as a fluorine resin (e.g. polytetrafluoroethylene), and a silicone resin; inorganic materials such as titanium oxide, silica, alumina, zirconium oxide, tin oxide, indium oxide, and potassium titanate.

The content of the filler added to the protective layer is preferably 10% by mass to 40% by mass, and more preferably 20% by mass to 30% by mass. When the content of the filler is less than 10% by mass, the filler is heavily worn, and has less durability. When the content of the filler is more than 40% by mass, it is not preferred that the potential at a bright area may be significantly increased during exposure, and the reduction of the sensitivity may not be ignored. The particle diameter of the filler is preferably 0.3 μm to 1.2 μm, and more preferably 0.3 μm to 0.7 μm as an average primary particle diameter. When the particle diameter is smaller, the wear resistance is not sufficient. When the particle diameter is larger, a writing light may be scattered. Thus the smaller or larger particle diameter is not preferable.

A dispersing assistant may be added to improve the dispersibility of the filler in the protective layer. The dispersing assistant used for coating may be used accordingly, for example, a modified epoxy resin condensate, an unsaturated polycarboxylic acid low molecular mass polymer. The content of the dispersing assistant is preferably 0.5% by mass to 4% by mass, and more preferably 1% by mass to 2% by mass based on the content of the filler.

Examples of the methods for forming the protective layer include common methods such as a spray coating method and a ring coating method. The thickness of the protective layer is not particularly limited, and may be appropriately selected depending on the intended purpose. It is preferably 0.5 μm to 10 μm, and more preferably 4 μm to 6 μm.

—Undercoat Layer—

The undercoat layer may be disposed between the substrate and the photosensitive layer. The undercoat layer is disposed for the purpose of improving adhesive property, preventing moire, improving the coating property of an upper layer, and reducing residual potential.

The undercoat layer contains at least a resin and fine powders, and further contains other components as necessary.

Examples of the resins include water-soluble resins such as polyvinyl alcohol, casein and sodium polyacrylate; alcohol-soluble resins such as copolymerized nylon and methoxymethylated nylon; curable resins forming a three dimensional network such as a polyurethane resin, a melamine resin, an alkyd-melamine resin, and an epoxy resin.

Examples of the fine powders include metal oxides, metal sulfides, and metal nitrides such as titanium oxide, silica, alumina, zirconium oxide, tin oxide and indium oxide.

The thickness of the undercoat layer is not particularly limited, and may be appropriately selected depending on the intended purpose. It is preferably 0.1 μm to 10 μm, and more preferably 1 μm to 5 μm.

—Intermediate Layer—

In the photoconductor, the intermediate layer may be disposed on the substrate in order to improve adhesive property and charge blocking property as necessary. The main component of the intermediate layer is a resin, which is preferably a resin having high resistant to organic solvents in view of disposing the photosensitive layer by coating a solvent thereon. The same resins as the undercoat layer may be used accordingly for the intermediate layer.

In the electrophotographic photoconductor, another intermediate layer can be disposed between the photosensitive layer and the protective layer. A binder resin is generally used as a main component for the intermediate layer. Examples of the binder resin include a poly amide resin, an alcohol-soluble nylon, a water-soluble polyvinyl butyral resin, a polyvinyl butyral resin, and a polyvinylalcohol resin. Examples of the method for forming the intermediate layer include the typical coating methods. The thickness of the intermediate layer is preferably 0.05 μm to 2 μm.

In addition, an antioxidant may be added to each of the charge generating layer, the charge transporting layer and the undercoat layer, the protective layer, and the single-layer photosensitive layer in the electrophotographic photoconductor of the present invention, for the purpose of improving environment resistance, particularly preventing the reduction of sensitivity and increase of residual potential.

Examples of the antioxidants include a phenol compound, paraphenylenediamines, organic sulfur compounds and organic phosphorus compounds.

Examples of the phenol compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris (3,5-di-t-butyl-4-hydroxybenzyl)benzene, tetrakis-[methylene-3-(3', 5'-di-t-butyl-4'-hydroxyphenyl)propionate]methane, bis[3,3'-bis (4'-hydroxy-3'-t-butylphenyl)butylic acid]glycol ester and tocopherols.

Examples of the paraphenylenediamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorus compounds include triphenylphosphine, tri (nonylphenyl) phosphine, tri (dinonylphenyl) phosphine, tricresyl phosphate and tri (2,4-dibutylphenoxy) phosphine.

These compounds are know as antioxidants for rubbers, plastics, and oils and fats, and commercialized products can be obtained easily.

The additive amount of the antioxidant is preferably 0.01% by mass to 10% by mass based on the total mass of the layer to which the antioxidant is added.

The latent electrostatic image forming step is the step of forming a latent electrostatic image, for example, by charging the surface of the electrophotographic photoconductor and subsequently exposing imagewisely using the latent electrostatic image forming unit.

The latent electrostatic image forming unit, for example, contains at least a charging unit configured to charge the surface of the electrophotographic photoconductor, and an exposing unit configured to expose the surface of the electrophotographic photoconductor imagewise.

The charging step is the step of charging, for example, by applying a voltage to the surface of the electrophotographic photoconductor using the charging unit.

The charging unit is not particularly limited and may be appropriately selected depending on the intended purpose. Examples of the charging units include the known contact charging units equipped with a conductive or semi-conductive roller, brush, film, rubber blade, or the like and noncontact charging units using corona discharge such as corotron and scorotron, or the like.

The form of the charging member is not particularly limited, and may be in any form such as a magnetic brush, and fur brush other than the roller depending on the specification and form of the electrophotographic apparatuses. For example, the magnetic brush is composed of a charging member using various ferrite particles such as Zn—Cu ferrite, a nonmagnetic conductive sleeve configured to support the charging member, and a magnet roll which is included in the nonmagnetic conductive sleeve. Examples of the materials of the fur brush include carbon, copper sulfide, a fur conductively processed with metal or metal oxide. The charging unit is formed by winding or affixing the material of the fur brush to the metal or conductively processed metal cored bar.

The exposing step is, for example, the step of exposing the surface of the electrophotographic photoconductor imagewise using a exposing unit.

The exposing unit is not particularly limited and may be appropriately selected depending on the intended purpose as long as it can expose imagewisely the surface of the electrophotographic photoconductor that has been charged by the charging unit.

Examples thereof include various exposing units such as a copy optical system, a rod lens array system, a laser optical system, and a liquid crystal shutter optical system.

A backlight system may be employed in the present invention by which the electrophotographic photoconductor is exposed imagewise from the back surface.

—Developing Step and Developing Unit—

The developing step is the step of developing the latent electrostatic image using a toner and/or developer to form a visible image (toner image).

The visible image can be formed, for example, by developing the latent electrostatic image using the toner and/or developer using the developing unit.

The developing unit is not particularly limited and may be selected from the known developing units as long as it can develop the latent electrostatic image using the toner and/or the developer depending on the intended purpose. Examples thereof include a developing unit containing the toner and/or the developer and having at least a developing equipment which can supply the toner and/or the developer to the latent electrostatic image in a contact or noncontact manner.

<Toner>

The toner is obtained by at least one of dissolving and dispersing a toner material containing at least an active hydrogen group-containing compound and a polymer that is reactive with the active hydrogen group-containing compound in an organic solvent to form a toner solution, at least one of emulsifying and dispersing the toner solution in an aqueous medium containing resin fine particles, allowing the active hydrogen group-containing compound and the polymer that is reactive with the active hydrogen group-containing compound to react in the aqueous medium to granulate adhesive base materials, and removing the organic solvent.

The toner material contains at least an adhesive base material which can be obtained by processing the active hydrogen group-containing compound and the polymer reactive with the active hydrogen group-containing compound in the aqueous medium containing resin fine particles, and further contains other components such as the binder resin, the colorant, the releasing agent, the charge controlling agent as necessary.

—Adhesive Base Material—

The adhesive base material may exhibit adhesiveness to a recording medium such as paper and contains at least an adhesive polymer produced by reacting an active hydrogen group-containing compound with the polymer reactive therewith in an aqueous medium containing the resin fine particles, and may further contain the binder resin selected from the known binder resins.

The mass average molecular mass of the adhesive base material is not particularly limited, and may be appropriately selected depending on the intended purpose. It is preferably 1,000 or more, more preferably 2,000 to 10,000,000, and particularly preferably 3,000 to 1,000,000. When the mass average molecular mass is less than 1,000, the hot offset resistance may be adversely affected.

The storage modulus of the adhesive base material is not particularly limited, and may be appropriately selected depending on the intended purpose. For example, the temperature TG', at which the storage modulus determined at a measurement frequency of 20 Hz is 10,000 dyne/cm$^2$, is preferably 100° C. or more, and more preferably from 110° C. to 200° C. When the temperature TG' is less than 100° C., the hot offset resistance may be adversely affected.

The viscosity of the adhesive base material is not particularly limited, and may be appropriately selected depending on the intended purpose. For example, the temperature Tη, at which the viscosity determined at a measurement frequency of 20 Hz is 1,000 poises, is preferably 180° C. or less, and more preferably from 90° C. to 160° C. When the temperature (Tη) is more than 180° C., the low-temperature fixing property may be adversely affected.

From the viewpoint of concurrent achievement of the hot offset resistance and the low-temperature fixing property, the temperature TG' is preferably higher than the temperature Tη. Specifically, the difference between TG' and Tη, TG'−Tη, is preferably 0° C. or more, more preferably 10° C. or more, and still more preferably 20° C. or more. The higher the difference is, the better the effect will be.

From the viewpoint of the concurrent achievement of the high-temperature storage stability and the low-temperature fixing property, the difference between TG' and Tη, TG'−Tη, is preferably from 0° C. to 100° C., more preferably from 10° C. to 90° C., and most preferably from 20° C. to 80° C.

The adhesive base material is not particularly limited, and may be appropriately selected depending on the intended purpose. Polyesters are particularly preferable.

The polyesters are not particularly limited, and may be appropriately selected depending on the intended purpose, for example, a urea-modified polyester is particularly preferable.

The urea-modified polyester is obtained by a reaction between amines (B) as an active hydrogen group-containing compound, and polyester prepolymer having an isocyanate group (A) as a polymer reactive with the active hydrogen group-containing compound in the aqueous medium.

The urea-modified polyester may include a urethane bond as well as a urea bond. A molar ratio of the urea bond to the urethane bond is preferably 100/0 to 10/90, more preferably 80/20 to 20/80, and still more preferably 60/40 to 30/70. When a molar ratio of the urea bond is less than 10%, the hot-offset resistance may be adversely affected.

Preferred examples of the urea-modified polyesters are as the following (1) to (10): (1) A mixture of (i) polycondensation product of bisphenol A ethyleneoxide 2-mole adduct and isophthalic acid, and (ii) urea-modified polyester prepolymer which is obtained by reacting isophorone diisocyanate with a polycondensation product of bisphenol A ethyleneoxide 2-mole adduct and isophthalic acid, and modifying with isophorone diamine; (2) A mixture of (iii) a polycondensation product of bisphenol A ethyleneoxide 2-mole adduct and terephthalic acid, and (ii) urea-modified polyester prepolymer which is obtained by reacting isophorone diisocyanate with a polycondensation product of bisphenol A ethyleneoxide 2-mole adduct and terephthalic acid, and modifying with isophorone diamine; (3) A mixture of (iv) polycondensation product of bisphenol A ethyleneoxide 2-mole adduct, bisphenol A propyleneoxide 2-mole adduct and terephthalic acid, and (v) urea-modified polyester prepolymer which is obtained by reacting isophorone diisocyanate with polycondensation product of bisphenol A ethyleneoxide 2-mole adduct, bisphenol A propyleneoxide 2-mole adduct and terephthalic acid, and modifying with isophorone diamine; (4) A mixture of (vi) polycondensation product of bisphenol A propyleneoxide 2-mole adduct and terephthalic acid, and (v) urea-modified polyester prepolymer which is obtained by reacting isophorone diisocyanate with polycondensation product of bisphenol A ethyleneoxide 2-mole adduct, bisphenol A propyleneoxide 2-mole adduct and terephthalic acid, and modifying with isophorone diamine; (5) A mixture of (iii) polycondensation product of bisphenol A ethyleneoxide 2-mole adduct and terephthalic acid, and (vii) urea-modified polyester prepolymer which is obtained by reacting isophorone diisocyanate with polycondensation product of bisphenol A ethyleneoxide 2-mole adduct and terephthalic acid, and modifying with hexamethylene diamine; (6) A mixture of (iv) polycondensation product of bisphenol A ethyleneoxide 2-mole adduct, a bisphenol A propyleneoxide 2-mole adduct and terephthalic acid, and (vii) urea-modified polyester prepolymer which is obtained by reacting isophorone diisocyanate with polycondensation product of bisphenol A ethyleneoxide 2-mole adduct and terephthalic acid, and modifying with hexamethylene diamine; (7) A mixture of (iii) polycondensation product of bisphenol A ethyleneoxide 2-mole adduct and terephthalic acid, and (viii) urea-modified polyester prepolymer which is obtained by reacting isophorone diisocyanate with polycondensation product of bisphenol A ethyleneoxide 2-mole adduct and terephthalic acid, and modifying with ethylene diamine; (8) A mixture of (i) polycondensation product of bisphenol A ethyleneoxide 2-mole adduct and isophthalic acid, and (ix) urea-modified polyester prepolymer which is obtained by reacting diphenylmethane diisocyanate with polycondensation product of bisphenol A ethyleneoxide 2-mole adduct and isophthalic acid, and modifying with hexamethylene diamine; (9) A mixture of (iv) polycondensation product of bisphenol A ethyleneoxide 2-mole adduct, bisphenol A propyleneoxide 2-mole adduct, and terephthalic acid, and (x) urea-modified polyester prepolymer which is obtained by reacting diphenylmethane diisocyanate with polycondensation product of bisphenol A ethyleneoxide 2-mole adduct, bisphenol A propyleneoxide 2-mole adduct, terephthalic acid and dodecenylsuccinic anhydride, and modifying with hexamethylene diamine; (10) A mixture of (i) polycondensation product of bisphenol A ethyleneoxide 2-mole adduct and isophthalic acid, and (xi) urea-modified polyester prepolymer which is obtained by reacting toluene diisocyanate with polycondensation product of bisphenol A ethyleneoxide 2-mole adduct and isophthalic acid, and modifying with hexamethylene diamine.

—Active Hydrogen Group-Containing Compound—

The active hydrogen group-containing compound act as an elongating agent, and cross-linking agent when a polymer reactive with the active hydrogen group-containing compound is elongated and/or cross-linked in an aqueous medium.

The active hydrogen group-containing compound is not particularly limited as long as it contains an active hydrogen group, and may be appropriately selected depending on the intended purpose. For example, when the polymer reactive with the active hydrogen group-containing compounds is the isocyanate group-containing polyester prepolymer (A), from the viewpoint of the ability to increase molecular mass by reactions such as elongation reaction, crosslinking reaction, or the like with the isocyanate group-containing polyester prepolymer (A), amines (B) may be preferably used.

The active hydrogen group is not particularly limited, and may be appropriately selected depending on the intended purpose. Examples thereof include hydroxyl groups such as an alcoholic hydroxyl group and a phenolic hydroxyl group; amino groups; carboxyl groups; and mercapto groups. These may be used alone or in combination. Of these, the alcoholic hydroxyl group is particularly preferable.

The amines (B) are not particularly limited, and may be appropriately selected depending on the intended purpose. Examples of the amines (B) include diamine compounds (B1), polyamine compounds with three or more valences (B2), amino alcohols (B3), amino mercaptans (B4), amino acids (B5) and components in which amino groups of B1 to B5 are blocked (B6).

These may be used alone or in combination. Of these, the diamine compounds (B1), and a mixture of the diamine compounds (B1) with a small amount of the polyamine compounds with three or more valences (B2) are particularly preferable.

Examples of the diamine compounds (B1) include an aromatic diamine, an alicyclic diamine, and an aliphatic diamine. Examples of the aromatic diamines include phenylene diamine, diethyltoluene diamine, and 4,4'-diaminodiphenylmethane. Examples of the alicyclic diamines include 4,4'-diamino-3,3'-dimethyldicyclohexylmethane, diamine cyclohexane and isophorone diamine. Examples of the aliphatic diamines include ethylene diamine, tetramethylene diamine and hexamethylene diamine.

Examples of the polyamine compounds with three or more valences (B2) include diethylenetriamine and triethylenetetramine.

Examples of the amino alcohols (B3) include ethanolamine and hydroxyethylaniline.

Examples of the amino mercaptans (B4) include an aminoethyl mercaptan and aminopropyl mercaptan.

Examples of the amino acids (B5) include aminopropionic acid and aminocaproic acid.

Examples of the components in which amino groups of B1 to B5 are blocked (B6) include a ketimine compound obtained from any one of the amines (B1) to (B5) and ketones such as acetone, methyl ethyl ketone and methyl isobutyl ketone; and an oxazolidine compound.

A reaction terminator may be used to stop elongation reaction, crosslinking reaction, or the like between the active hydrogen group-containing compound and polymers reactive with the active hydrogen group-containing compound. It is preferable to use the reaction terminator because it enables to control the molecular mass of the adhesive base material within a preferable range. Examples of the reaction terminators include monoamines such as diethylamine, dibutylamine, butylamine, laurylamine, and block compounds in which these monoamines are blocked, such as ketimine compound.

The mixing ratio of the amines (B) to the polyester prepolymer having an isocyanate group (A) is defined by the mixing equivalent ratio, $[NCO]/[NH_x]$, of an isocyanate group [NCO] in the polyester prepolymer having an isocyanate group (A) to an amino group $[NH_x]$ in the amines (B), preferably 1/3 to 3/1, more preferably 1/2 to 2/1, and still more preferably 1/1.5 to 1.5/1.

When the mixing equivalent ratio $[NCO]/[NH_x]$ is less than 1/3, the low-temperature fixing property may be reduced, and when it is more than 3/1, the molecular mass of the urea—modified polyester may become lower, and the hot offset resistance may be possibly impaired.

—Polymer Reactive With Active Hydrogen Group-Containing Compound—

The polymer reactive with the active hydrogen group-containing compound (hereinafter may be referred to as "prepolymer") is not particularly limited, and may be appropriately selected from the known resins depending on the intended purpose as long as it contains at least a site reactive with the active hydrogen group-containing compound. Examples thereof include a polyol resin, a polyacryl resin, a polyester resin, an epoxy resin, and derivative resins thereof. These may be used alone or in combination. Of these, the polyester resin is particularly preferable in terms of high flowability and transparency at melting.

The site reactive with the active hydrogen group-containing compounds of the prepolymer is not particularly limited, and may be appropriately selected from the known substituents depending on the intended purpose. Examples of substituents include an isocyanate group, an epoxy group, a carboxylic acid, and an acid chloride group. These may be used alone or in combination. Of these, the isocyanate group is particularly preferable.

Among the prepolymers, the polyester resin containing urea bond formation group (RMPE) is particularly preferable, because it is easy to control the molecular mass of polymer elements and has oilless fixing ability at low-temperature in dry toner, particularly the ability to sustain favorable releasing and fixing abilities even when it lacks releasing oil coating system for the heating medium for fixation.

Examples of the urea bond formation groups include an isocyanate group. When the urea bond formation group in the polyester resins containing urea bond formation group (RMPE) is an isocyanate group, the isocyanate group-containing polyester prepolymer (A) is particularly preferable as the polyester resin (RMPE).

The isocyanate group-containing polyester prepolymer (A) is not particularly limited, and may be appropriately selected depending on the intended purpose, for example, a polycondensate between a polyol (PO) and a polycarboxylic acid (PC), provided it is also a reactant of the active hydrogen group-containing polyester resin and a polyisocyanate (PIC).

Examples of the polyols (PO) include diols (DIO), trihydric or higher polyols (TO), and a mixture of a diol (DIO) and a trihydric or higher polyol (TO). These may be used alone or in combination. As the polyols (PO), the diol (DIO) alone, and a mixture of the diol (DIO) and a small amount of the trihydric or higher polyol (TO) are preferred.

Examples of diols (DIO) include alkylene glycols, alkylene ether glycols, alicyclic diols, alkylene oxide adducts of the alicyclic diols, bisphenols, and alkylene oxide adducts of the bisphenols. Examples of the alkylene glycols include those having 2 to 12 carbon atoms such as ethylene glycol, 1,2-propylene glycol, 1,3-propylene glycol, 1,4-butanediol and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexanedimethanol and hydrogenated bisphenol A. Examples of the alkylene oxide adducts of the alicyclic diols such as ethylene oxide, propylene oxide and butylene oxide. Examples of the bisphenols include bisphenol A, bisphenol F and bisphenol S. Examples of the alkylene oxide adducts of the bisphenols include ethylene oxide, propylene oxide and butylene oxide. Of these, the alkylene glycol having 2 to 12 carbon atoms and the alkylene oxide adduct of bisphenols are preferable, and a mixture of the alkylene oxide adduct of bisphenols and the alkylene glycol having 2 to 12 carbon atoms is particularly preferable.

Examples of the trihydric or higher polyols (TO) include those having 3 to 8 or more valences such as polyhydric aliphatic alcohol having three or more valences, polyphenols having three or more valences, and alkylene oxide adduct of polyphenols having three or more valences.

Examples of the polyhydric aliphatic alcohols having three or more valences include glycerin, trimethylol ethane, trimethylol propane, pentaerythritol, and sorbitol. Examples of the polyphenols having three or more valences include trisphenol PA, phenol novolac and cresol novolac. Examples of the alkylene oxide adducts of the polyphenols having three or more valences include ethylene oxide, propylene oxide, and butylene oxide.

The mixing mass ratio, DIO:TO, of the diol (DIO) to the trihydric or higher polyols (TO) is not particularly limited and may be appropriately selected depending on the intended purpose, and it is preferably 100:0.01 to 100:10, and more preferably 100:0.01 to 100:1.

The polycarboxylic acid (PC) is not particularly limited, and may be appropriately selected depending on the intended purpose. Examples thereof include dicarboxylic acids (DIC), trihydric or higher polycarboxylic acids (TC), and a mixture of the dicarboxylic acids (DIC) and the trihydric or higher polycarboxylic acids (TC). These may be used alone or in combination. Of these, the dicarboxylic acid (DIC) alone and a mixture of the dicarboxylic acid (DIC) and a small amount of the trihydric or higher polycarboxylic acid (TC) is preferred.

Examples of the dicarboxylic acids include alkylenedicarboxylic acids, alkenylenedicarboxylic acids, and aromatic dicarboxylic acids.

Examples of the alkylenedicarboxylic acids include succinic acid, adipic acid, and sebacic acid. The alkenylenedicarboxylic acids having 4 to 20 carbon atoms are preferred. Examples thereof include maleic acid, and fumaric acid. The aromatic dicarboxylic acids having 8 to 20 carbon atoms are preferred. Examples thereof include phthalic acid, isophthalic acid, terephthalic acid, and naphthalenedicarboxylic acid. Of these, the alkenylenedicarboxylic acid having 4 to 20 carbon atoms, and the aromatic dicarboxylic acid having 8 to 20 carbon atoms are preferred.

The trihydric or higher polycarboxylic acid (TC) having 3 to 8 or more are preferred. Examples thereof include aromatic polycarboxylic acid.

The aromatic polycarboxylic acids having 9 to 20 carbon atoms are preferred. Examples thereof include trimellitic acid and pyromellitic acid.

An acid anhydride or lower alkyl ester of any one of the dicarboxylic acid (DIC), the trihydric or higher polycarboxylic acid (TC), and the mixture of the dicarboxylic acid (DIC) and trihydric or higher polycarboxylic acid (TC) can be used as the polycarboxylic acid(PC). Examples of the lower alkyl esters include methyl ester, ethyl ester, and isopropyl ester.

The mixing mass ratio, DIC:TC, of the dicarboxylic acid (DIC) and the trihydric or higher polycarboxylic acid (TC) is not particularly limited and may be appropriately selected depending on the intended purpose, and it is preferably 100:0.01 to 100:10, and more preferably 100:0.01 to 100:1.

A mixing ratio of the polyol (PO) and the polycarboxylic acid (PC) at the time of polycondensation reaction is not particularly limited, and may be appropriately selected depending on the intended purpose. For example, the equivalent ratio, [OH]/[COOH], of a hydroxyl group [OH] of the polyol (PO) and a carboxyl group [COOH] of the polycarboxylic acid (PC) in general is preferably 2/1 to 1/1, more preferably 1.5/1 to 1/1, and particularly preferably 1.3/1 to 1.02/1.

The content of the polyol (PO) in the polyester prepolymer having an isocyanate group (A) is not particularly limited, and may be appropriately selected depending on the intended purpose. It is preferably 0.5% by mass to 40% by mass, more preferably 1% by mass to 30% by mass, and particularly preferably 2% by mass to 20% by mass.

When the content is less than 0.5% by mass, the hot-offset resistant may be adversely affected, and the satisfactory high-temperature storage stability and low-temperature fixing property may not be obtained concurrently. When the content is more than 40% by mass, the low-temperature fixing property may be adversely affected.

The polyisocyanate (PIC) is not particularly limited, and may be appropriately selected depending on the intended purpose. Examples thereof include aliphatic polyisocyanates, alicyclic polyisocyanates, aromatic diisocyanates, aromatic-aliphatic diisocyanates, isocyanurates, the blocked products of the polyisocyanates with phenol derivatives, oximes, or caprolactams.

Examples of the polyisocyanates include tetramethylene diisocyanate, hexamethylene diisocyanate, and 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate. Examples of the alicyclic polyisocyanates include isophorone diisocyanate, and cyclohexylmethane diisocyanate. Examples of the aromatic diisocyanates include tolylene diisocyanate, diphenylmethane diisocyanate, and 1,5-naphtylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate. Examples of the aromatic-aliphatic diisocyanates include $\alpha,\alpha,\alpha',\alpha'$-tetramethylxylylene diisocyanate. Examples of the isocyanurates include tris-isocyanatoalkyl-isocyanurate, and triisocyanatocycloalkyl-isocyanurate. These may be used alone or in combination.

The mixing ratio of the polyisocyanate (PIC) to the active hydrogen group-containing polyester resin, for example, hydroxyl group-containing polyester resin, is defined by the mixing equivalent ratio [NCO]/[OH] of an isocyanate group [NCO] in the polyisocyanate (PIC) to a hydroxyl groups [OH] in the hydroxyl group-containing polyester resin, preferably 5/1 to 1/1, more preferably 4/1 to 1.2/1, and particularly preferably 3/1 to 1.5/1.

When the isocyanate group [NCO] is more than 5, the low-temperature fixing property may be adversely affected. When the isocyanate group [NCO] is less than 1, the hot offset resistance may be adversely affected.

The content of the polyisocyanate (PIC) in the polyester prepolymer having an isocyanate group (A) is not particularly limited, and may be appropriately selected depending on the intended purpose, preferably 0.5% by mass to 40% by mass, more preferably 1% by mass to 30% by mass, and still more preferably 2% by mass to 20% by mass.

When the content is less than 0.5% by mass, the hot-offset resistant is adversely affected, and satisfactory high-temperature storage stability and low-temperature fixing property may not be obtained concurrently. When the content is more than 40% by mass, the low-temperature fixing property may be adversely affected.

The average number of the polyester prepolymer having an isocyanate group (A) per molecule is 1 or more, preferably 1.2 to 5, and more preferably 1.5 to 4.

When the average number of the isocyanate group per molecule is less than 1, the resulting polyester resin containing urea bond formation group (RMPE) may have a low molecular weight and the hot offset resistance may be adversely affected.

The average molecular mass of the polymer reactive with the active hydrogen group-containing compound is preferably 1,000 to 30,000 and more preferably 1,500 to 15,000, in terms of molecular mass distribution by gel permeation chromatography (GPC) of tetrahydrofuran (THF) soluble component. When the average molecular mass of the polymer reactive with the active hydrogen group-containing compound is less than 1,000, the high-temperature storage stability is adversely affected. When the mass average molecular mass of polymer reactive with the active hydrogen group-containing compound is more than 30,000, the low-temperature fixing property may be adversely affected.

The molecular mass distribution by gel permeation chromatography (GPC) is determined by the following conditions.

A column is stabilized in a chamber heated at a temperature of 40° C. Then, tetrahydrofuran (THF) as an eluent is fed through the column at a flow rate of 1 ml/min at 40° C. Separately, 50 μl to 200 μl of tetrahydrofuran resin sample solution adjusted to the concentration of 0.05% by mass to 0.6% by mass is poured into the column, and then measured. For measuring the molecular mass of the sample, the molecular mass distribution of the sample is calculated from the relationship between the logarithmic value of calibration curve obtained from plural types of monodisperse polystyrene standard samples and the count number. Examples of the polystyrene standard samples for forming a calibration curve include those having a molecular mass of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ commercially available typically from Pressure Chemical Co. or Toyo Soda K.K. It is appropriate to use at least 10 standard polystyrene samples. For the detection, a refractive index (RI) detector can be used.

—Binder Resin—

The binder resin is not particularly limited and may be appropriately selected depending on the intended purpose. Examples thereof include polyester resins. An unmodified polyester resin, a polyester resin not being modified, is particularly preferable.

The unmodified polyester resin contained in the toner allows to improve the low-temperature fixing property and glossiness.

Examples of the unmodified polyester resins include the one similar to urea bond formation group-containing polyester resin such as a polycondensation of the polyol (PO) and the polycarboxylic acid (PC). The unmodified polyester resin of which a part is compatible with the urea bond formation group-containing polyester resin (RMPE), that is, both have similar structures that are compatible to each other, is preferable in terms of the low-temperature fixing property and hot offset resistance.

The average molecular mass of the unmodified polyester resin is preferably 1,000 to 30,000, and more preferably 1,500 to 15,000, in terms of the molecular mass distribution by GPC (Gel Permeation Chromatography) of tetrahydrofuran (THF) soluble component. The content of the component of which the average molecular mass of less than 1,000 should be 8% by mass to 28% by mass in order to prevent deterioration of high-temperature storage stability. When the average molecular mass is more than 30,000, the low-temperature fixing property may be adversely affected.

The glass transition temperature of the unmodified polyester resin is preferably 30° C. to 70° C., more preferably 35° C. to 70° C., still more preferably 35° C. to 50° C., and particularly preferably 35° C. to 45° C. When the glass transition temperature is less than 30° C., the high-temperature storage stability of the toner may be adversely affected. When the glass transition temperature is more than 70° C., the low-temperature fixing property may be insufficient.

The hydroxyl value of the unmodified polyester resin is preferably 5 mgKOH/g or more, more preferably from 10 mgKOH/g to 120 mgKOH/g, and still more preferably from 20 mgKOH/g to 80 mgKOH/g. When the hydroxyl value is less than 5 mgKOH/g, the satisfactory high-temperature storage stability and low-temperature fixing property may not be obtained concurrently.

The acid value of the unmodified polyester resin is preferably 1.0 mgKOH/g to 50.0 mgKOH/g, more preferably 1.0 mgKOH/g to 45.0 mgKOH/g, and still more preferably 15.0 mgKOH/g to 45.0 mgKOH/g. A toner having such an acid value may be easily negatively charged.

When the unmodified polyester resin is contained in the toner, the mixing mass ratio, RMPE/PE, of the urea bond formation group-containing polyester resin (RMPE) to the unmodified polyester resin (PE) is preferably 5/95 to 25/75, and more preferably 10/90 to 25/75.

When the mixing mass ratio of the unmodified polyester resin (PE) is more than 95, the hot offset resistance may be adversely affected, and the satisfactory high-temperature storage stability and low-temperature fixing property may not be obtained concurrently. When the mixing mass ratio of the unmodified polyester resin (PE) is less than 25, the glossiness may be adversely affected.

The content of the unmodified polyester resin in the binder resin is preferably 50% by mass to 100% by mass, more preferably 70% by mass to 95% by mass, and still more preferably 80% by mass to 90% by mass. When the content is less than 50% by mass, the low-temperature fixing property and glossiness of an image may be adversely affected.

—Resin Fine Particles—

The resin fine particles are not particularly limited and may be formed of any known resin, as long as it can form an aqueous dispersion in an aqueous medium, and can be either a thermoplastic resin or a thermosetting resin. Examples thereof include a vinyl resin, a polyurethane resin, an epoxy resin, a polyester resin, a polyamide resin, a polyimide resin, a silicone resin, a phenol resin, a melamine resin, a urea resin, an aniline resin, an ionomer resin, and a polycarbonate resin. These may be used alone or in combination. Of these, the resin fine particles are preferably formed from at least any one of the vinyl resin, the polyurethane resin, the epoxy resin, and the polyester resin are preferred in terms of easy preparation of an aqueous dispersion of spherical resin fine particles.

The vinyl resin is a homopolymer or copolymer of a vinyl monomer. Examples thereof include a styrene-(meth)acrylic ester resin, a styrene-butadiene copolymer, a (meth)acrylic acid-acrylic ester polymer, a styrene-acrylonitrile copolymer, a styrene-maleic anhydride copolymer and a styrene-(meth) acrylic acid copolymer.

Moreover, the resin fine particles may be formed of a copolymer containing a monomer having at least two unsaturated groups.

The monomer having at least two unsaturated groups is not particularly limited, and may be appropriately selected depending on the intended purpose. Examples thereof include sodium salt of sulfuric acid ester of methacrylic acid ethylene oxide adduct (Eleminol RS-30 by Sanyo Chemical Industries Co.), divinylbenzene, and 1,6-hexanediol acrylate.

The resin fine particles may be formed by polymerizing by the method appropriately selected from the known methods. The resin fine particles are preferably obtained in the form of aqueous dispersion of the resin fine particles. Examples of the methods for preparing the aqueous dispersion of the resin fine particles include the following (1) to (8):

(1) In the case of the vinyl resin, a vinyl monomer is used as a starting material, the aqueous dispersion of the resin fine particles is directly produced by any of the polymerization selected from suspension polymerization, emulsion polymerization, seed polymerization and dispersion polymerization.

(2) In the case of a polyaddition or condensation resin, such as the polyester resin, the polyurethane resin, and the epoxy resin, the aqueous dispersion of resin fine particles is produced by dispersing a precursor (a monomer, an oligomer and the like) or a solvent solution thereof in an aqueous medium in the presence of a suitable dispersing agent, and then curing by heating or adding a curing agent.

(3) In the case of a polyaddition or condensation resin such as a polyester resin, a polyurethane resin, and an epoxy resin, an appropriate emulsifier is dissolved in a precursor (such as a monomer, an oligomer and the like) or a solvent solution thereof which is preferably a liquid and may be liquefied by heating, and then adding water for phase-reversal emulsification.

(4) A resin prepared by a polymerization reaction, which may be any polymerization reaction mode, such as addition polymerization, ring-opening polymerization, polyaddition polymerization, addition-condensation polymerization, and condensation polymerization, in advance, is crushed with a mechanical rotary, jet type or other micropulverizer, and the resulting powder is classified to obtain resin fine particles, and then the obtained resin fine particles are dispersed in water in the presence of an appropriate dispersing agent.

(5) A resin solution in which a resin prepared by a polymerization reaction, which may be any polymerization reaction mode, such as addition polymerization, ring-opening polymerization, polyaddition polymerization, addition- condensation polymerization, and condensation polymerization, in advance, is dissolved, and the resulting resin solution is sprayed in a mist form to obtain resin fine particles, and the obtained resin fine particles are dispersed in water in the presence of an appropriate dispersing agent.

(6) A poor solvent is added to a resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, or a resin solution in which a resin is dissolved by heating in advance is cooled to precipitate resin fine particles, and then the solvent is removed to obtain resin fine particles, and the obtained resin fine particles are dispersed in water in the presence of a suitable dispersing agent.

(7) A resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, and the resulting resin solution is dispersed in an aqueous medium in the presence of a suitable dispersing agent, and then the aqueous dispersion is heated or decompressed to remove the solvent.

(8) A suitable emulsifier is dissolved in a resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, and then water is added for phase-reversal emulsification.

The glass transition temperature of the resin fine particles is 65° C. to 85° C. When the glass transition temperature is less than 65° C., the high-temperature storage stability under high temperature and high humidity may be decreased, and then the toner blocking may be occurred. Thus, the toner transferring ability may be adversely affected. When the glass transition temperature is more than 85° C., the low-temperature fixing property may be impaired, and the offset may occur.

The glass transition temperature of the resin fine particles, for example, is measured as follows:

<Measurement of Glass Transition Temperature of Resin Fine Particles>

The glass-transition temperature can be measured using $\alpha$-$Al_2O_3$ as a standard sample by means of TG-DSC system TAS-100 (by Rigaku Denki Co., Ltd.) according to the following method: initially, about 10 mg of the sample is weighed in an aluminum sample vessel. The sample is heated from a room temperature to 150° C. at a temperature rising rate of 10° C./min. After being left to stand at 150° C. for 10 minutes, the sample is cooled to a room temperature and allowed to leave to stand for 10 minutes. Then, under a nitrogen atmosphere, DSC measurement is carried out by heating the sample to 150° C. at a temperature rising rate of 10° C./min. From the obtained DSC curve, the glass-transition temperature of the resin fine particles is determined from an intersection of a tangential line of the endothermic curve and the base line.

—Other Components—

The other components are not particularly limited, and may be appropriately selected depending on the intended purpose. Examples thereof include a colorant, a releasing agent, a charge controlling agent, an inorganic fine particles, a flow improver, a cleaning improver, a magnetic material, and a metal soap.

The colorant is not particularly limited, and may be appropriately selected from the known dyes and pigments depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G and R), tartrazinelake, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methyl-violet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone. These may be used alone or in combination.

The content of the colorant in the toner is not particularly limited, and may be selected appropriately depending on the intended purpose. It is preferably 1% by mass to 15% by mass, and more preferably 3% by mass to 10% by mass. When the content is less than 1% by mass, the coloring power of the toner may be reduced. When the content is more than 15% by mass, the pigment may not be sufficiently dispersed in the toner, which may lead to the decrease of the coloring power and electrical property of the toner.

The colorant may be used as a master batch compounded with a resin. The resin is not particularly limited, and may be appropriately selected from the know resins depending on the intended purpose. Example thereof include styrene or substituted polymer thereof, a styrene copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic hydrocarbon resin, alicyclic hydrocarbon resin, aromatic petroleum resin, chlorinated paraffin, and paraffin. These may be used alone or in combination.

Examples of the styrenes or substituted polymers thereof include polyesters, polystyrenes, poly-p-chlorostyrenes, and dpolyvinyltoluenes. Examples of the styrene copolymers include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl a-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleic ester copolymer.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with a resin and an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used for mixing and kneading.

The releasing agent is not limited, and may be appropriately selected from the know releasing agents depending on the intended purpose. For example, wax is preferably use.

Examples of the wax include carbonyl group-containing wax, polyolefin wax, and long-chain hydrocarbon. These may be used alone or in combination. Of these, the carbonyl group-containing wax is preferably used.

Examples of the carbonyl group-containing wax include polyalkanoic acid esters, polyalkanol esters, polyalkanoic acid amides, polyalkylamides, and dialkyl ketones. Examples of the polyalkanol esters include carnauba wax, montan wax, trimethylolpropane tribehenate, pentaerythritol tetrabehenate, pentaerythritol diacetate dibehenate, glycerol tribehenate, and 1,18-octadecanediol distearate. Examples of the polyalkanol esters include tristearyl trimellitate, and distearyl maleate. Examples of the polyalkanoic acid amides include dibehenyl amide. Examples of the polyalkylamides include tristearylamide trimellitate. Examples of the dialkyl ketones include distearyl ketone. Of these carbonyl group-containing wax, polyalkanoic acid esters are preferably used.

Examples of the polyolefin wax include polyethylene wax and polypropylene wax.

Examples of the long-chain hydrocarbon include paraffin wax and Sasol wax.

The melting point of the releasing agent is not particularly limited, and may be appropriately selected depending on the intended purpose. It is preferably 40° C. to 160° C., more preferably 50° C. to 120° C., and still more preferably 60° C. to 90° C. When the melting point of the releasing agent is less than 40° C., the wax may adversely affect to the high-temperature storage stability. When the melting point of the releasing agent is more than 160° C., the cold offset may easily occur during fixing at lower temperature.

The melt viscosity of the releasing agent is preferably 5 cps to 1,000 cps, and more preferably 10 cps to 100 cps as a measured value at 20° C. higher temperature than the melting point of the wax.

When the melt viscosity of the releasing agent is less than 5 cps, the releasing property may be lowered. When the melt viscosity of the releasing agent is more than 1,000 cps, the hot-offset resistant and low-temperature fixing property may not be improved.

The content of the releasing agent in the toner is not particularly limited and may be appropriately selected depending on the intended purpose. It is preferably 0% by mass to 40% by mass, and more preferably 3% by mass to 30% by mass. When the content is more than 40% by mass, the flowability of the toner may be adversely affected.

The charge controlling agent is not particularly limited, and may be appropriately selected from the known charge controlling agents depending on the intended purpose. The charge controlling agent is preferably made of a material having color close to transparent and/or white because colored materials may change color tone. Examples thereof include triphenylmethane dye, molybdic acid chelate pigment, rhodamine dye, alkoxy amine, a quaternary ammonium salt such as a fluorine-modified quaternary ammonium salt, alkylamide, a phosphoric simple substance or a compound thereof, a tungsten simple substance or a compound thereof, a fluorine-containing active agent, a metal salt of salicylic acid, and a metal salt of salicylic acid derivative. These may be used alone or in combination.

Examples of the charge control agents include commercially available products under the trade names of Bontron P-51 of a quaternary ammonium salt, Bontron E-82 of an oxynaphthoic acid metal complex, Bontron E-84 of a salicylic acid metal complex, Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron complex (by Japan Carlit Co., Ltd.); quinacridone, azo pigment; and other high-molecular mass compounds having a functional group such as a sulfonic acid group, a carboxyl group and a quaternary ammonium salt.

The charge controlling agent may be dissolved and/or dispersed in the toner material after melt kneading with the master batch. The charge controlling agent may also be added directly at the time of dissolving and/or dispersing in an organic solvent together with the toner material. In addition, the charge controlling agent may be added onto the surface of the toner particle after the toner particle is produced.

The content of the charge controlling agent in the toner is determined depending on the kinds of the binder resins, presence or absence of additives used accordingly and the methods for producing the toner including a dispersing method and is not defined unambiguously. The content of the charge controlling agent is preferably 0.1 parts by mass to 10 parts by mass, and more preferably 0.2 parts by mass to 5 parts by mass based on 100 parts by mass of the binder resin. When the content of the charge controlling agent is less than 0.1 parts by mass, the charge may not be appropriately controlled. When the content of the charge controlling agent is more than 10 parts by mass, the effect of the charge controlling agent is weakened and electrostatic suction force to the developing roller is increased due to too much charging ability of the toner, which may lead to the reduction of flowability of the developer or image density.

Examples of the toner include a toner which is produced by the known methods such as suspension-polymerization method, emulsion-aggregation method, emulsion-dispersion method, and the like. The toner is preferably produced by dissolving the toner material containing an active hydrogen group-containing compound and a polymer reactive with the active hydrogen group-containing compound in an organic solvent to prepare a toner solution, dispersing the toner solution in an aqueous medium so as to form a dispersion, allowing the active hydrogen group-containing compound and the polymer reactive with the active hydrogen group-containing compound to react so as to form an adhesive base material in the form of particles, and removing the organic solvent.

—Toner Solution—

The toner solution is prepared by dissolving the toner material in the organic solvent.

—Organic Solvent—

The organic solvent is not particularly limited, and may be appropriately selected depending on the intended purpose, provided that the organic solvent allows the toner material to be dissolved and/or dispersed therein. The organic solvent is preferably a volatile organic solvent having a boiling point of less than 150° C. in terms of easy removal from the solution or dispersion. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Of these solvents, the toluene, xylene, benzene, methylene chloride, 1,2-dichloroethane, chloroform, carbon tetrachloride are preferable. The ethyl acetate is particularly preferable. These may be used alone or in combination.

The content of the organic solvents is preferably 40 parts by mass to 300 parts by mass, more preferably 60 parts by mass to 140 parts by mass, and still more preferably 80 parts by mass to 120 parts by mass based on 100 parts by mass of the toner material.

—Dispersion—

The dispersion is prepared by dispersing the toner solution in the aqueous medium.

When the toner solution is dispersed in the aqueous medium, a dispersing element of the toner solution (oil droplets) is formed in the aqueous medium.

—Aqueous Medium—

The aqueous medium is not particularly limited, and may be appropriately selected from the known aqueous mediums. Examples therepof include water alone, a water-miscible solvent, and a mixture thereof. Of these, the water is particularly preferable.

The water-miscible solvent is not particularly limited. Examples thereof include alcohol, dimethylformamide, tetrahydrofran, cellsolves, and lower ketones.

Examples of the alcohols include methanol, isopropanol and ethylene glycol. Examples of the lower ketones include acetone and methyl ethyl ketone. These may be used alone or in combination.

The toner solution is preferably dispersed in the aqueous medium while stirring.

The dispersing method is not particularly limited and may be appropriately selected from the known dispersing devices. Examples of dispersing devices include a low-speed shearing dispersing device, a high-speed shearing dispersing device, a dispersing device using friction, a high-pressure jetting dispersing device, and an ultrasonic dispersing device. Of these, the high-speed shearing dispersing device is preferred in terms of allowing the dispersion (oil droplets) to have an average particle diameter of 2 μm to 20 μm.

When the high-speed shearing dispersing device is used, the condition of the number of rotation, dispersion time, and dispersing temperature is not particularly limited and may be appropriately selected depending on the intended purpose. The number of rotation is preferably 1,000 rpm to 30,000 rpm and more preferably 5,000 rpm to 20,000 rpm. The dispersion time is preferably 0.1 minutes to 5 minutes in a batch system. The dispersing temperature is preferably 0° C. to 150° C. under a pressure, and more preferably 40° C. to 98° C. The dispersion is preferably performed at a relatively high temperature because of the easiness of the dispersion.

An exemplary production process of the toner in which the toner is obtained by producing the adhesive base material in a form of particles is described below.

In the process in which toner is granulated by producing adhesive base material in a form of particles, a preparation of an aqueous medium phase, for example, a preparation of toner solution, a preparation of dispersion, an addition of aqueous medium and other processes such as a synthesis of the polymer reactive with the active hydrogen group-containing compound (prepolymer), and a synthesis of the active hydrogen group-containing compound are preformed.

The aqueous medium phase is prepared by dispersing the resin fine particles into the aqueous medium. The additive amount of the binder resin in the aqueous medium is not particularly limited, and may be appropriately selected depending on the intended purpose. It is preferably 0.5% by mass to 10% by mass.

The toner solution may be prepared by dissolving and/or dispersing toner materials such as the active hydrogen group-containing compound, the polymer reactive with the active hydrogen group-containing compound, the colorant, the releasing agent, the charge controlling agent and the unmodified polyester resin, and the like in the organic solvent.

These toner materials other than the polymer reactive with the active hydrogen group-containing compound (prepolymer) may be added and mixed in the aqueous medium when resin fine particles are dispersed in the aqueous medium in the preparation of the aqueous medium phase, or they may be added into the aqueous medium phase together with the toner solution when the toner solution is added into the aqueous medium phase.

The preparation of dispersion may be carried out by emulsifying and/or dispersing the prepared toner solution in the prepared aqueous medium phase. At the time of emulsifying and/or dispersing, the active hydrogen group-containing compound and the polymer reactive with the active hydrogen group-containing compound are subjected to elongation and/or crosslinking reaction, thereby forming the adhesive base material.

The adhesive base material (e.g. the urea-modified polyester resin) is formed, for example, by (1) emulsifying and/or dispersing the toner solution containing the polymer reactive with the active hydrogen group-containing compound (e.g. the polyester prepolymer having an isocyanate group (A)) in the aqueous medium phase together with the active hydrogen group-containing compound (e.g. amines (B)) so as to form a dispersion, and subsequently elongating and/or crosslinking the active hydrogen group-containing compound and the polymer reactive with the active hydrogen group-containing compound in the aqueous medium phase; (2) emulsifying and/or dispersing toner solution in the aqueous medium to which the active hydrogen group-containing compound are added beforehand to form a dispersion, and subsequently elongating and/or crosslinking the active hydrogen group-containing compound and the polymer reactive with the active hydrogen group-containing compound in the aqueous medium phase; (3) first adding the toner solution to the aqueous medium, and mixing, sequentially adding the active hydrogen group-containing compound thereto so as to form a dispersion, and subsequently elongating and/or crosslinking the active hydrogen group-containing compound and the polymer reactive with the active hydrogen group-containing compound at an interface of dispersed particles in the aqueous medium phase. In the process (3), it should be noted that the modified polyester resin is preferentially formed on the surface of the toner particles to be produced, thus it is possible to generate concentration gradient in the toner particles.

The condition of the reaction for forming the adhesive base material by emulsifying and/or dispersing is not particularly limited, and may be adjusted accordingly with a combination of the active hydrogen group-containing compound and the polymer reactive with the active hydrogen group-containing compound. A suitable reaction time is preferably 10 minutes to 40 hours, and more preferably 2 hours to 24 hours. A suitable reaction temperature is preferably 0° C. to 150° C., and more preferably 40° C. to 98° C.

A method for stably forming the dispersing element containing the polymer reactive with the active hydrogen group-containing compound (e.g. the polyester prepolymer having an isocyanate group (A)) in the aqueous medium phase is, for example, a process in which the toner solution, which is produced from the toner material such as the polymer reactive with the active hydrogen group-containing compound (e.g. the polyester prepolymer having an isocyanate group (A)), the colorant, the releasing agent, the charge controlling agent, the unmodified polyester, and the like that are dissolved and/or dispersed in the organic solvent, is added in the aqueous medium phase and dispersed by shear force. The details of the dispersion process is as described above.

When preparing dispersion, a dispersing agent is preferably used in order to stabilize the dispersing element (the oil droplets formed from the toner solution) and sharpen the particle size distribution while obtaining a predetermined shape of the dispersing element.

The dispersing agent is not particularly limited, and may be appropriately selected depending on the intended purpose. Examples thereof include a surfactant, an inorganic compound dispersing agent with poor water solubility, and a polymer protective colloid. These may be used alone or in combination. Of these, the surfactant is preferred.

Examples of the surfactants include anionic surfactants, cationic surfactants, nonionic surfactants, and amphoteric surfactants.

Examples of the anionic surfactants include alkylbenzene sulfonic acid salts, α-olefin sulfonic acid salts, phosphoric acid ester and fluoroalkyl group-containing anionic surfactants. Among these the fluoroalkyl group-containing anionic surfactant is preferred. Examples of the fluoroalkyl group-containing anionic surfactants include fluoroalkylcarboxylic acids each containing 2 to 10 carbon atoms, and metallic salts thereof, disodium perfluorooctanesulfonyl glutamate, sodium 3-[omega-fluoroalkyl (having 6 to 11 carbon atoms) oxy]-1-alkyl (having 3 to 4 carbon atoms) sulfonate, sodium 3-[omega-fluoroalkanoyl (having 6 to 8 carbon atoms)-N-ethylamino]-1-propanesulfonate, fluoroalkyl (having 11 to 20 carbon atoms) carboxylic acids and metallic salts thereof, perfluoroalkyl carboxylic acids (having 7 to 13 carbon atoms) and metallic salts thereof, perfluoroalkyl (having 4 to 12 carbon atoms) sulfonic acids and metallic salts thereof, perfluorooctanesulfonic acid diethanolamide, N-propyl-N-(2-hydroxyethyl) perfluorooctanesulfonamide, perfluoroalkyl (having 6 to 10 carbon atoms) sulfonamide propyl trimethyl ammonium salts, perfluoroalkyl (having 6 to 10 carbon atoms)-N-ethylsulfonyl glycine salts, and monoperfluoroalkyl (having 6 to 16 carbon atoms) ethyl phosphoric esters. Examples of the fluoroalkyl group-containing surfactants include commercially available products under the trade names of SURFLON S-111, S-112 and S-113 (by Asahi Glass Co., Ltd.), FLUORAD FC-93, FC-95, FC-98 and FC-129 (by Sumitomo 3M Limited), UNIDYNE DS-101 and DS-102 (by Daikin Industries, Ltd.), MEGAFAC F-110, F-120, F-113, F-191, F-812 and F-833 (by Dainippon Ink & Chemicals, Incorporated), EFTOP EF-102, 103, 104, 105, 112, 123A, 123B, 306A, 501, 201 and 204 (by JEMCO Inc.), and FTERGENT F-100 and F-150 (by Neos Co., Ltd.).

Examples of the cationic surfactants include cationic surfactants of amine salt type, cationic surfactants of quaternary ammonium salt type and cationic surfactants having a fluoroalkyl group. Examples of the cationic surfactants of amine salt type include alkyl amine salt, aminoalcohol fatty acid derivative, polyamine fatty acid derivative and imidazoline. Examples of the cationic surfactants of quaternary ammonium salt type include alkyltrimethyl ammonium salt, dialkyldimethyl ammonium salt, alkyldimethyl benzyl ammonium salt, pyridinium salt, alkyl isoquinolinium salt, and benzethonium chloride. Examples of the cationic surfactants having a fluoroalkyl group include aliphatic primary, secondary and tertiary amine acids each having a fluoroalkyl group; aliphatic quaternary ammonium salts such as perfluoroalkyl (having 6 to 10 carbon atoms) sulfonamide propyltrimethylammonium salts; benzalkonium salts; benzethonium chloride; pyridinium salts; and imidazolinium salts. Examples of the cationic surfactants include commercially available products under the trade names of SURFLON S-121 (by Asahi Glass Co., LTD.), FLUORAD FC-135 (by Sumitomo 3M Limited), UNIDYNE DS-202 (by Daikin Industries, LTD.), MEGAFAC F-150, and F-824 (by Dainippon Ink & Chemicals, Incorporated), EFTOP EF-132 (by JEMCO Inc.), and FTERGENT F-300 (by Neos Co., Ltd.).

Examples of the nonionic surfactants include fatty acid amide derivatives and polyhydric alcohol derivatives.

Examples of the amphoteric surfactants include alanine, dodecyl di(aminoethyl) glycine, di(octylaminoethyl) glycine, and N-alkyl-N,N-dimethylammonium betaines.

The inorganic compound dispersing agents with poor water solubility include tricalcium phosphate, calcium carbonate, titanium oxide, colloidal silica and hydroxyl apatite.

Examples of the polymer protective colloids include acids, hydroxyl-group-containing (meth)acrylic monomers, vinyl alcohols and ethers thereof, esters of compounds containing vinyl alcohol and a carboxyl group, amide compounds and methylol compounds thereof, chlorides, homopolymer and copolymer containing a nitrogen-atom or having nitrogen-containing heterocyclic ring, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the hydroxyl-group-containing (meth)acrylic monomers include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide and N-methylol methacrylamide.

Examples of the vinyl alcohols and ethers thereof include vinylmethylether, vinylethylether and vinylpropylether. Examples of the esters of compounds containing vinyl alcohol and a carboxyl group include vinyl acetate, vinyl propionate and vinyl butyrate. Examples of the amide compounds and methylol compounds thereof include acrylamide, methacrylamide, diacetoneacrylamide, and a methylol compound thereof. Examples of the chlorides include acrylic acid chloride, and methacrylic acid chloride. Examples of the homopolymer and copolymer containing a nitrogen-atom or having nitrogen-containing heterocyclic ring include vinyl pyridine, vinyl pyrolidone, vinyl imidazole and ethyleneimine. Examples of the polyoxyethylenes include polyoxyethylene, polyoxypropylene, polyoxyethylenealkylamine, polyoxypropylenealkylamine, polyoxyethylenealkylamide, polyoxypropylenealkylamide, polyoxyethylene nonylphenylether, polyoxyethylene laurylphenylether, polyoxyethylene stearylphenylester and polyoxyethylenenonyl phenyl ester. Examples of the celluloses include methylcellulose, hydroxyethylcellulose and hydroxypropylcellulose.

The dispersion is prepared by using a dispersion stabilizer as necessary.

Examples of the dispersion stabilizers include an acid- or alkali-soluble substance such as a calcium phosphate salt.

When the dispersion stabilizer is used, the calcium phosphate salt is removed from fine particles by the method in which a calcium phosphate salt is dissolved by an acid such as hydrochloric acid, followed by washing, or the method of decomposing with oxygen. Alternatively, the dispersion stabilizer can be removed by, for example, decomposition by action of an enzyme.

The dispersion is prepared by using a catalyst for the elongation and/or crosslinking reaction. Examples of the catalyst include dibutyltin laurate and dioctyltin laurate.

The organic solvent is removed from the obtained dispersion (emulsified slurry). For example, (1) by gradually elevating the temperate of the entire system and completely removing the organic solvent in the oil droplets by evaporation. (2) by spraying the emulsion into a dry atmosphere so as to completely remove the non-water-soluble organic solvent in the oil droplets to thereby form toner fine particles while removing the water-based dispersing agent by evaporation.

The toner particles are formed by removing the organic solvent. The toner particles can be washed and dried, and further classified as necessary. The toner particles can be classified by removing particle fractions, for example, using a cyclone, a decanter or a centrifugal separator in a liquid. Alternatively, the classification can be carried out on dried particles which is obtained by drying.

The obtained toner particles are subjected to mixing with particles of the colorant, the releasing agent, the charge controlling agent, etc., and by applying mechanical impact force in order to prevent particles such as those of the releasing agent from removing from the surface of the toner particles.

The methods for applying an mechanical impact force are, for example, a method in which the impact force is applied to mixed particles by using a rotating blade in high speed, a method in which the mixed particles are placed in high-speed flow with acceleration so as to subject the mixed particles or complex particles to collide with a suitable collision board, and the like. Examples of the apparatus therefor include angmill (by Hosokawa Micron Corporation), a modified I-type mill (by Nippon Pneumatic MFG., Co., Ltd.) which is reduced pulverizing air pressure, a hybridization system (by Nara Machine Corporation), Kryptron System (by Kawasaki Heavy Industries, Ltd.), and an automatic mortar.

The toner preferably has the following volume average particle diameter(Dv), volume average particle diameter (Dv)/number average particle diameter(Dn), and average circularity.

The volume average particle diameter(Dv) of the toner is preferably 3 μm to 8 μm, more preferably 4 μm to 7 μm, and still more preferably 5 μm to 6 μm. The volume average particle diameter is defined by the equation: $Dv=[(\Sigma(nD^3)/\Sigma n)^{1/3}$ (wherein, n represents the number of particles, D represents a particle diameter).

When the toner having a volume average particle diameter of less than 3 μm is used in a two-component developer, the toner may fuse and adhere to the carrier surface during long-term agitation in the developing unit to thereby decrease charge ability of the carrier. On the other hand, when the toner having a volume average particle diameter of less than 3 μm is used in a one-component developer, the toner may tend to invite filming to a developing roller or adhesion to another member such as blade by thinning the toner layer. When the volume average particle diameter is more than 8 μm, the toner may not sufficiently yield high-quality images with a high resolution and may often show large variation in its particle diameter after consumption and addition of the toner in the developer.

The ratio Dv/Dn of the volume average particle diameter (Dv) to the number average particle diameter(Dn) in the toner is preferably 1.25 or less, more preferably 1.00 to 1.20, and still more preferably 1.10 to 1.20.

When the ratio (Dv/Dn) of the volume average particle diameter to the number average particle diameter is 1.25 or less, the toner may have a sharp particle distribution and the fixing property may be improved. When theratio (Dv/Dn) of less than 1.00 is used in a two-component developer, the toner fuses and adheres to the carrier surface during long-term agitation in the developing unit to thereby decrease the charge ability of the carrier, and the cleaning property may be adversely affected. On the other hand, the ratio (Dv/Dn) of less than 1.00 is used in a one-component developer, the toner may tend to invite filming to the developing roller or adhesion to another member such as blade by thinning the toner layer. When the ratio (Dv/Dn) of the volume average particle diameter to the number average particle diameter is more than 1.20, the toner may not sufficiently yield high-quality images with a high resolution and may often show large variation in its particle diameter after consumption and addition of the toner in the developer.

The volume average particle diameter, and the ratio (Dv/Dn) of the volume average particle diameter to the number average particle diameter can be measured, for example, using a particle size analyzer Multisizer II (by Beckman Coulter, Inc.).

The average circularity of the toner is preferably 0.93 to 0.99. In the present invention, the circularity is defined to be the value obtained by the following mathematical formula. The circularity is the index showing a degree of unevenness of the toner particles. When the toner is completely spherical shape, the circularity is 1.00. The more complex the surface shape is, the smaller the value of the circularity becomes.

$$\text{Circularity } a=L_0/L \qquad \text{Mathematical Formula}$$

wherein, $L_0$ represents a circumference length of circle having the same area as that of projected area of a particle image and L represents a circumference length of projected image of a particle.

When the average circularity of the toner is 0.93 to 0.99, the surface of the toner particle is smooth, and the contact area among toner particles, and between toner particles and a photoconductor are small, thus the transferring ability may be excellent. The substantially-spherical toner particles leads to the small agitation torque of the developer in the developing device, and stable agitation drive, therefore, an abnormal image may not be formed. When a transfer medium is press contacted so as to transfer a visible image, the whole toners forming a dot is pressed uniformly because there are not relatively abrasive toner particles among the toners which forms the dot. Thus, a transfer void may not be easily occurred, and a high resolution image can be obtained. The grinding force of the toner particles themselves are small, because the toner particles substantially-spherical shape. Therefore, the surface of the photoconductor and the charging member and the like may not be damaged and worn.

The average circularity can be determined by a flow type particle image analyzer FPIA-1000 (by Sysmex Corporation). Specifically, the measurement is performed by the following method: 0.1 ml to 0.5 ml of a surfactant such as an alkylbenzene sulfonate as a dispersing agent is added to 100 ml to 150 ml of water from which solid impurities have been removed beforehand in a vessel, and then approximately 0.1 g to 0.5 g of the test sample is added. The suspension containing the dispersed test sample is subjected to dispersion treatment for approximately 1 minute to 3 minutes using an ultrasonic disperser, and the shape and distribution of the toner particles is determined by the above apparatus at a dispersion concentration of 3,000 particles per microliter to 10,000 particles per microliter.

The coloring of the toner is not particularly limited, and may be appropriately selected from the group consisting of black toner, cyan toner, magenta toner, and yellow toner depending on the intended purpose. The each color of the toner can be obtained by selecting the kinds of colorant appropriately. A color toner is preferred.

<Developer>

The developer contains at least the toner, and further contains other components such as a carrier, which is selected depending on the intended purpose. The developer may be one-component developer or two-component developer and it is preferably the two-component developer in terms of the improvement of the duration of life when the developer is used for high-speed printers which correspond to improvement of information processing speed of the recent years.

In the case of the one-component developer using the toner, even if addition and reduction of the toner takes place, the particle diameter of the toner is less fluctuated, filming of the toner on the developing roller and fusion of the toner to the members such as a blade for thinning a toner layer do not occur, and the appropriate and stable developing property and images can be obtained even after long-term use (stirring) of the developing device. Moreover, in the case of the two-component developer using the toner, even if addition and reduction of the toner takes place, the particle diameter of the toner in the developer is less fluctuation, and the appropriate and stable developing property can be obtained even for long-term stirring in the developing device.

The carrier is not particularly limited and may be appropriately selected depending on the intended purpose. The carrier having a core material and a resin layer which is coated on the core material is preferred.

The material of the core material is not particularly limited and may be appropriately selected from the known core materials, for example, preferably manganese-strontium (Mn—Sr) material and manganese-magnesium (Mn—Mg) material of 50 emu/g to 90 emu/g, and preferably a high magnetization material such as iron powder (100 emu/g or more) and magnetite (75 emu/g to 120 emu/g) in terms of securing image density. Moreover, a low magnetization material such as copper-zinc (Cu—Zn) of 30 emu/g to 80 emu/g is preferred, because the impact toward the photoconductor in which the toner is being a magnetic brush can be softened and it is advantageous for obtaining higher image quality. These may be used alone or in combination.

The average particle diameter (volume average particle diameter ($D_{50}$)) of the core material is preferably 10 μm to 200 μm, and more preferably 40 μm to 100 μm.

When the average particle diameter (volume average particle diameter ($D_{50}$)) is less than 10 μm, the amount of fine powders in the carrier particle distribution increases whereas magnetization per particle decreases, and then the carrier scattering may be occurred. When the average particle diameter is more than 200 μm, toner scattering may be caused due to the decrease of specific surface area. Therefore, the reproduction of the solid parts particularly may be insufficient in a full-color image having many solid parts.

The material of the resin layer is not particularly limited and may be appropriately selected from the known resins depending on the intended purpose. Examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer such as terpolymer of tetrafluoroethylene, a vinylidene fluoride and non-fluoro monomer and a silicone resin. These may be used alone or in combination.

The amine resins include a urea-formaldehyde resin, a melamine resin, a benzoguanamine resin, a urea resin, a polyamide resin, and an epoxy resin. Examples of the polyvinyl resins include an acrylic resin, a polymethyl methacrylate resin, a polyacrylonitrile resin, a polyvinyl acetate resin, a polyvinyl alcohol resin, and a polyvinyl butyral resin. Examples of the polystyrene resins include a polystyrene resin, and a styrene-acrylic copolymer. Examples of the halogenated olefin resins include polyvinyl chloride. The polyester resins include a polyethylene terephthalate resin, and a polybutylene terephthalate resin.

The resin layer may contain conductive powders as necessary. Examples of the conductive powders include metal powders, carbon black, titanium oxide, tin oxide, and zinc oxide. The average particle diameter of these conductive powders is preferably 1 μm or less. When the average particle diameter is more than 1 μm, it may be difficult to control electrical resistance.

The resin layer may be formed by uniformly coating the surface of the core material with a coating solution, which is prepared by dissolving silicone resins, etc. in a solvent, by the known coating method, drying, and followed by baking. The examples of the coating methods include dipping, spraying and brushing.

The solvent is not particularly limited and may be appropriately selected depending on the intended purpose. Examples thereof include toluene, xylene, methyl ethyl ketone, methyl isobutyl ketone, cellosolve and butyl acetate.

The baking is not particularly limited and may be an external heating system or an internal heating system. Examples thereof include methods using a fixed electric furnace, a fluid electric furnace, a rotary electric furnace, and a burner furnace, and methods using microwaves.

The content of the resin layers in the carrier is preferably 0.01% by mass to 5.0% by mass. When the amount is less than 0.01% by mass, the resin layer may not be formed uniformly on the surface of the core material. When the amount is more than 5.0% by mass, the resin layer becomes too thick and granulation among carriers occur and then the uniform carrier particles may not be obtained.

When the developer is the two-component developer, the content of the carrier in the two-component developer is not particularly limited and may be appropriately selected depending on the intended purpose. It is preferably 90% by mass to 98% by mass, and more preferably 93% by mass to 97% by mass.

The mixing ratio of the toner and the carrier in the two-component developer, 1 part by mass to 10.0 parts by mass of the toner based on 100 parts by mass of the carrier in general.

Because the developer contains the toner, the occurrence of filming in the photoconductor can be prevented. Thus an excellent clear high quality image can be stably formed without fluctuation of image nonuniformity.

The developing device may be of dry development type or wet development type and may be developing device for single color or multicolor. Examples thereof include a developing device which has a stirrer charging the toner and/or developer by friction stirring, and a rotatable magnet roller.

In the developing device, the toner and the carrier are stirred and mixed to charge the toner by friction and retain the toner in a condition of a magnetic brush on the surface of a rotating magnet roller. Since the magnet roller is positioned near the electrophotographic photoconductor (photoconductor), a part of the toner constructing the magnetic brush formed on the surface of the magnet roller moves to the surface of the electrophotographic photoconductor (photoconductor) by electric attraction. As a result, the latent electrostatic image is developed by the toner to form a visible image on the surface of the electrophotographic photoconductor (photoconductor) by the toner.

The developer contained in the developing device is the developer containing the toner used in the invention and may be one-component developer or two-component developer.

—Transferring Step and Transferring Unit—

The transferring step is the step of transferring the visible image to the recording medium and a intermediate transfer member is used. A preferred embodiment is that the visible image is primarily transferred to the intermediate transfer member, and then the visible image is secondarily transferred to the recording medium. A more preferable embodiment contains a primary transferring step of transferring a visible image to the intermediate transfer member so as to form a composite transfer image, and a secondary transferring step of transferring the composite transfer image to the recording medium using the toner of two or more colors, preferably a full-color toner.

The transferring step may be performed by charging the electrophotographic photoconductor (photoconductor) by means of a transfer charging device using the transferring unit. The preferred embodiment of the transferring unit contains a primary transferring unit configured to transfer a visible image to the intermediate transfer member so as to form a composite transfer image, and a secondary transferring unit configured to transfer the composite transfer image to the recording medium.

The intermediate transfer member is not particularly limited and may be appropriately selected from the known transfer member depending on the intended purpose. Examples thereof include a transfer belt.

The transferring unit (the primary transferring unit and the secondary transferring unit) preferably contains a transferring device configured to charge so as to separate and transfer the visible image formed on the electrophotographic photoconductor (photoconductor) to the recording medium. The transferring device may be used singly or in two or more. Examples of the transferring devices include a corona transfer device utilizing corona discharge, a transfer belt, a transfer roller, a pressure-transfer roller, and an adhesion-transfer device.

The common recording medium is a regular paper, but not particularly limited thereto, and may be selected depending on the intended purpose, as long as a developed unfixed image can be transferred thereon. For example, PET bases for OHP may be used.

—Fixing Step and Fixing Unit—

The fixing step is the step of fixing the transferred visible image on the recording medium using a fixing unit. The fixing step can be performed for the toner of each color every time it is transferred to the recording medium, or in one operation with the superimposed toners of each color.

The fixing unit is not particularly limited, and may be appropriately selected depending on the intended purpose. The fixing unit containing a fixing member and a heat source to heat the fixing member is preferably used. Examples of the fixing member include a combination of an endless belt and a roller, and a combination of rollers. The combination of an endless belt and a roller having small thermal capacity is preferably used so as to shorten the rise time, realize lower energy, and expand fixable width.

Figure 3:
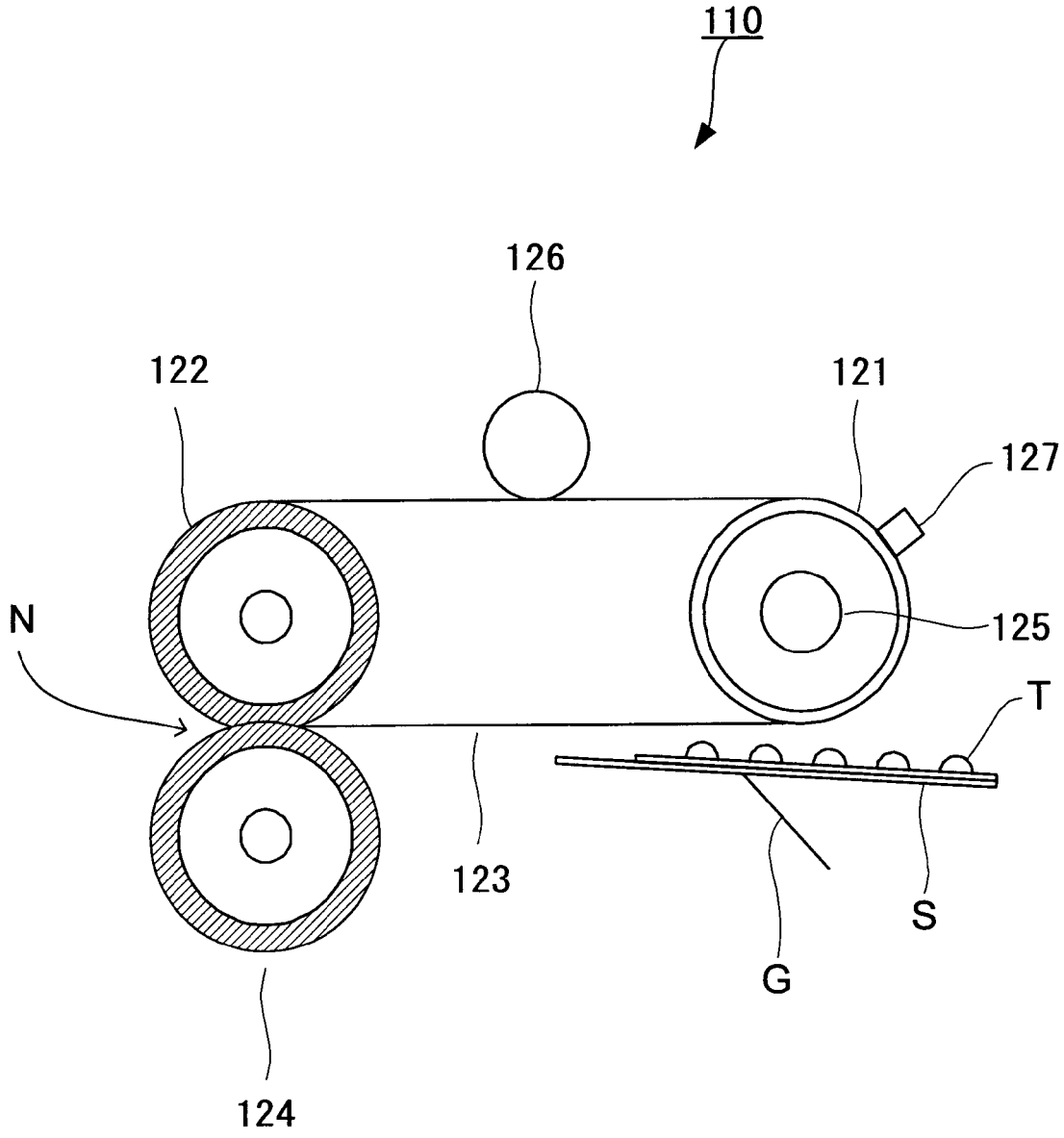
FIG. 3 is an illustration diagram showing an exemplary image fixing apparatus (belt fixing apparatus) of the present invention.

As shown in FIG. 3 a belt type image fixing apparatus 110 contains a heating roller 121, a fixing roller 122 and a fixing belt 123 as fixing members on the side of contacting an image, a pressurizing roller 124 as a fixing member on the side of noncontacting an image.

A fixing belt 123 is stretched around a heating roller 121 and a fixing roller 122 which are rotatably disposed inside the fixing belt, and is heated by the heating roller 121 at a predetermined temperature. The heating roller 121 houses a heat source 125 therein, and is configured to be able to control a temperature by a temperature sensor 127 which is fixed adjacent to the heating roller 121. The fixing roller 122 is rotatably disposed inside the fixing belt 123 so as to contact the inner surface of the fixing belt 123. The pressurizing roller 124 is rotatably disposed on the outer surface of the fixing belt 123 so as to press contact the fixing roller 122. The surface hardness of the fixing belt 123 as the fixing member on the side of contacting an image is lower than that of the pressurizing roller 124 as the fixing member on the side of noncontacting an image. At a nip portion N formed between the fixing roller 122 and the pressurizing roller 124, an intermediate area between a introduction side of a recording medium S and an ejection side of the recording medium S protrudes from the position of the introduction side and ejection side of the recording medium S to the direction of the fixing roller 122. That is, the nip portion N is convex upward in FIG. 3.

The belt type image fixing apparatus 110 in FIG. 3, first, a recording medium S on which a toner image T to be fixed is formed is conveyed to the heating roller 121. Then, the toner image T on the recording medium S is heated so as to be in melt condition by means of the heating roller 121 which is heated at a predetermined temperature by the heat source 125 housed therein, and the fixing belt 123. Under the melt condition, the recording medium S is inserted to the nip portion N formed between the fixing roller 122 and the pressurizing roller 124. The recording medium S inserted in the nip portion N is contacted with the surface of the fixing belt 123 which rotates in linkage with the rotation of the fixing roller 122 and pressurizing roller 124, and is pressed while passing through the nip portion N to thereby fix the toner image T on the recording medium S. The wax near the surface of the toner T exudes when the toner image T is fixed. Therefore, an excellent fixing and releasing property can be obtained.

Next, the recording medium S on which the toner image T is fixed passes between the fixing roller 122 and the pressurizing roller 124, separated from the fixing belt 123, and conveyed to a tray (not shown) via a guide G. The recording medium S is ejected to the direction of the pressurizing roller 124 as the fixing member on the side of noncontacting an image, thus the recording medium S is prevented from winding around the fixing belt 123. The fixing belt 123 is cleaned by a cleaning roller 126. The toner T has an excellent releasing property because the appropriate amount of the wax presents near the surface of the toner T, thus, the melt of the toner T from the cleaning roller 126 to the fixing belt 123 can be prevented.

The charge eliminating step is the step of applying a bias voltage to the charged electrophotographic photoconductor for removal of charge, and it may be preferably performed by the charge eliminating unit.

The charge eliminating unit is not particularly limited, and may be appropriately selected from the known charge eliminating units depending on the intended purpose as long as it can apply a bias voltage to the charged electrophotographic photoconductor for removal of charge. Example thereof include a charge eliminating lamp.

The cleaning step is the step of removing the residual toner on the electrophotographic photoconductor, and may be preferably performed by the cleaning unit. Alternatively, the method in which the residual toner is uniformly charged by a rubbing member, and recovered by the developing roller may be adopted without using the cleaning unit.

The cleaning unit is not particularly limited, and may be appropriately selected from the known cleaners as long as it can remove the toner remaining on the electrophotographic photoconductor. Examples thereof include a magnetic brush cleaner, a static brush cleaner, a magnetic roller cleaner, a blade cleaner, a brush cleaner and a web cleaner.

The recycling step is the step of recycling the toner removed in the cleaning step to the developing step, and may be preferably performed by the recycling unit.

The recycling unit is not particularly limited, and the known transporting units may be used.

The controlling step is the step of controlling each of the above-mentioned steps, and may be preferably performed by the controlling unit.

The controlling unit is not particularly limited, and may be appropriately selected depending on the intended purpose, as long as it can control the behavior of each of the units. Examples thereof include equipments such as a sequencer and a computer.

Figure 4:
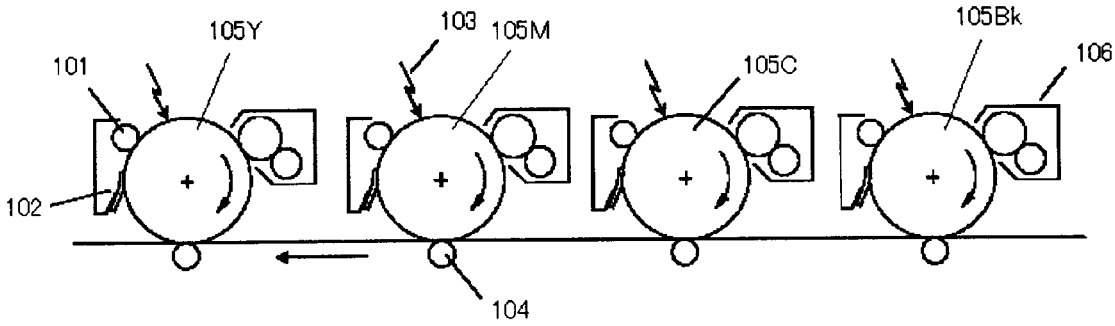
FIG. 4 is a schematic view showing an exemplary image forming apparatus of the present invention.

A part of one embodiment of the full-color image forming apparatus which uses the apparatus of the present invention will be explained with reference to a schematic diagram shown in FIG. 4. The image forming apparatus in FIG. 4 is a tandem image forming apparatus, in which a photoconductor drum is not shared among respective colors, but photoconductor drums 105Y, 105M, 105C, 105Bk are respectively disposed for colors of yellow (Y), magenta (M), cyan (C), and black (Bk). A charging brush 101 configured to uniformly charge a photoconductor drum, a developing unit 106 configured to develop a latent electrostatic image using a toner to form a visible image, a transfer roller 104 configured to transfer the visible image onto a recording medium, and a rubbing member 102 are also disposed for respective colors. The tandem image forming apparatus can form a latent image and develop with respect to each color in parallel, thus can form an image far faster than a revolver image forming apparatus. In the tandem image forming apparatus, the residual toner unevenly charged after transferring is uniformly charged appropriately by the rubbing member 102, and once recovered by applying a bias voltage by means of the charging brush 101, again placed back to the photoconductor drum by applying a bias voltage at an appropriate timing, recovered again in the developing part, and then reused. Therefore, the rubbing member 102 is appropriately applied with a bias voltage and pressure to uniformly charge the toner. The cleaning can be performed without a cleaning blade by uniformly charging the residual toner using the rubbing member 102, and recovering by means of the developing roller.

<Process Cartridge>

The process cartridge contains at least the electrophotographic photoconductor and the developing unit configured to develop the latent electrostatic image on the electrophotographic photoconductor using the toner to form the visible image, and further contains other units as necessary. The process cartridge is detachably attached to the image forming apparatus.

The process cartridge is detachably attached to various electrophotographic image forming apparatuses, facsimiles and printers, and it is preferably detachably attached to the image forming apparatus of the present invention.

The process cartridge, for example, as illustrated in the image forming apparatus in FIG. 4, is preferably an apparatus (component) which houses each photoconductor drum for yellow (Y), magenta (M), cyan (C), and black (Bk), and further contains the charging unit, the exposing unit, the developing unit, the transferring unit, and the rubbing member integrally.

Figure 5:
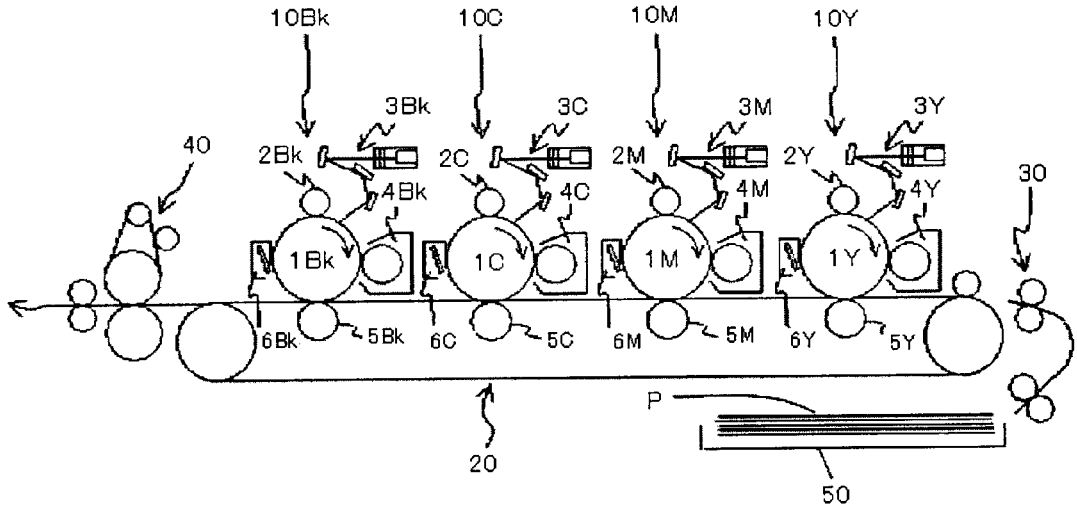
FIG. 5 is a schematic view showing an exemplary image forming apparatus of the present invention.

Another example of the image forming apparatus of the present invention is shown in FIG. 5. The image forming apparatus is the so called tandem image forming apparatus in which a plurality of image forming units 10Y, 10M, 10C, 10Bk are arranged along a transfer belt configured to transfer a recording medium P as a recording medium in order from the upstream side of the moving direction of the transfer belt 20. An apparatus for driving a moving body can be used as a driving apparatus for the transfer belt 20 which is a moving body of the tandem image forming apparatus.

The each image forming unit 10Y, 10M, 10C, and 10Bk in the image forming apparatus is respectively configured to sequentially form images of yellow, magenta, cyan, and black color by an electrophotographic process. The each image forming unit has a common internal configuration, though it only forms an image of different color. The configuration of the each image forming unit, as shown in FIG. 5, Y, M, C, Bk are respectively added to the end of the reference numerals which denote common components to identify each image forming unit. The configuration of the image forming unit 10Y is mainly explained hereinbelow. The explanation of other image forming units are omitted by substituting the configuration of the image forming unit 10Y, because the other image forming units are configured the same as the image forming unit 10Y.

In FIG. 5, the transfer belt 20 is configured as an endless belt. the transfer belt 20 is configured to be rotatable by being stretched around a driving roller which is driven to rotate and a driven roller which is driven to be rotated. A paper feeding tray 50 housing a sheaf of recording media is placed below the transfer belt 20. The recording medium P which is located on the top among the sheaf of recording media housed in the paper feeding tray 50 is sent out at the time of forming an image, and adsorbed to the outer circumferential surface of the transfer belt 20 by electrostatic adsorption. The recording medium P adsorbed to the outer circumferential surface of the transfer belt 20 is first conveyed to the image forming unit 10Y which is placed in the upstream side of the rotation direction of the transfer belt 20.

The image forming unit 10Y contains a photoconductor drum 1Y as an electrophotographic photoconductor, a charging unit 2Y, a exposing unit 3Y, a developing unit 4Y, a cleaning unit for photoconductor 6Y, which are disposed around the photoconductor drum 1Y.

The exposing unit 3Y is a laser scanner, and is configured to reflect laser light from a laser source by a polygon mirror, and output the laser light through an optical system using a fθ lens, a deflecting mirror, and the like. The circumferential surface of the photoconductor drum 1Y is uniformly charged by the charging unit 2Y in the dark at the time of forming an image.

Then, the circumferential surface of the charged photoconductor drum 1Y is exposed to laser light of the image light corresponding to a yellow image from the exposing unit 3Y. As a result, a latent electrostatic image corresponding to the yellow image is formed on the circumferential surface of the charged photoconductor drum 1Y. The latent electrostatic image is developed to a visible image using a yellow toner which is supplied from a developing unit 4Y. Thereby, a yellow toner image is formed on the photoconductor drum 1Y.

The yellow toner image is transferred onto the recording medium P by a transferring unit 5Y disposed opposite to the photoconductor drum 1Y via the transfer belt 20 at a transferring position where the photoconductor drum 1Y contacts the recording medium P on the transfer belt 20. Consequently, the yellow toner image is formed on the recording medium P. After transferring the image, residual toner on the circumferential surface of the photoconductor drum 1Y is removed by the cleaning unit for photoconductor 6Y, and then the photoconductor drum 1Y is prepared to form the next image.

The recording medium P on which the yellow toner image is transferred by the image forming unit 1Y is conveyed to the image forming unit 10M by the transfer belt 20. In the image forming unit 10M, a magenta toner image is formed on the photoconductor drum 1M by the same process as in the image forming unit 10Y. The magenta toner image is transferred so as to be superimposed onto the yellow toner image on the recording medium P by a transferring unit 5M at the transferring position where the photoconductor drum 1M contacts the recording medium P on the transfer belt 20.

The recording medium P on which the yellow toner image and magenta toner image are transferred is conveyed to the next image forming unit 10C by the transfer belt 20. In the image forming unit 10C, a cyan toner image is formed on a photoconductor drum 1C by the same process as in the image forming units 10Y and 10M. The cyan toner image is transferred so as to be superimposed onto the yellow and magenta toner images on the recording medium P by a transferring unit 5C at a transferring position where the photoconductor drum 1C contacts the recording medium P on the transfer belt 20.

The recording medium P on which the yellow toner image, magenta toner image and cyan toner image are transferred is conveyed to the next image forming unit 10Bk by the transfer belt 20. In the image forming unit 10Bk, a black toner image is formed on a photoconductor drum 1Bk by the same process as in the image forming units 10Y, 10M and 10C. The black toner image is transferred so as to be superimposed onto the yellow, magenta and cyan toner images on the recording medium P by a transferring unit 5Bk at a transferring position where the photoconductor drum 1Bk contacts the recording medium P on the transfer belt 20.

Thus, on the recording medium P, a full-color image in which yellow, magenta, cyan and black toner images are synthesized are formed on the recording medium P. The recording medium P on which the synthesized full-color image is formed passes though the image forming unit 10Bk, is separated from the transfer belt 20, the image is fixed thereon by a fixing unit 40, and then the recording medium P is ejected.

The image forming apparatus and image forming method of the present invention impart the excellent toner transferring ability, thus residual toner after transferring, which is a cause for fog, can be significantly reduced, and a high quality image can be formed without causing fog even after long term use, because the toner having a glass transition temperature of the resin fine particles of 65° C. to 85° C., and the electrophotographic photoconductor having a glass transition temperature of the outermost layer of 100° C. or more are used.

EXAMPLES

Hereinafter, with referring to Examples and Comparative Examples, the invention is explained in detail and the following Examples and Comparative Examples should not be construed as limiting the scope of this invention. In Examples and Comparative Examples, all part(s) and percentage (%) are expressed by mass-basis unless indicated otherwise.

A volume average particle diameter of a toner and an average circularity of a toner are measured as follows:

<Measurement of Volume Average Particle Diameter of Toner>

The volume average particle diameter (Dv) of the toner was measured using particle size analyzer, Multisizer III (by Beckman Coulter, Inc.) at an aperture of 100 μm, and then analyzed with an analysis software (Beckman Coulter Mutlisizer 3 Version3.51).

Specifically, 0.5 ml of a 10% by mass surfactant (alkylbenzene sulfonate salt, Neogem SC-A by Dai-ichi Kogyo Seiyaku Co., Ltd.), and 0.5 g of each toner were placed in a 100 ml glass beaker, stirred with a microspatel(microspatula), and then 80 ml of ion exchange water was added therein. The obtained dispersion was dispersed by an ultrasonic disperser W-113MK-II (by Honda Electronics Co., Ltd.) for 10 minutes. The dispersion was measured using ISOTON-III as a electrolytic solution by means of the Multisizer III (by Beckman Coulter, Inc.). The dispersion of the toner sample was dropped so as to be the density of 8±2%. It is important to make the density be 8±2% in terms of measurement reproducibility of the particle diameter in this measurement method. The errors may not occur in the particle diameter in this density range.

<Average Circularity of Toner>

The average circularity of the toner were measured by means of a flow type particle image analyzer, FPIA-2100 by Sysmex Corporation. Specifically, 0.1 ml to 0.5 ml of a surfactant, preferably alkylbenzene sulfonate as a dispersing agent was added to 100 ml to 150 ml of water from which solid impurities had been removed beforehand in a vessel, and then 0.1 g to 0.5 g of each toner was added and dispersed. The obtained dispersion was subjected to dispersion treatment for approximately 1 minute to 3 minutes using an ultrasonic disperser until dispersion concentration became 3,000 particles per microliter to 10,000 particles per microliter and the shape and distribution of the toner were measured. From these measurement result, the average circularity was obtained.

Production Example 1

—Production of Photoconductor 1—

On an aluminum cylinder, a coating liquid for the undercoat layer, a coating liquid for the charge generating layer, and a coating liquid for the charge transporting layer were dip-coated in this order, and dried to form a 3.5 μm-thick undercoat layer, a 0.2 μm-thick charge generating layer, and a 22 μm-thick charge transporting layer. Thus, "Photoconductor 1" was produced. The compositions of the coating liquids for the undercoat layer, charge generating layer, and charge transporting layer were as follows:

—Composition of Coating Liquid for Undercoat Layer—

| | |
|---|---|
| Titanium dioxide powder | 400 parts by mass |
| Melamine resin | 65 parts by mass |
| Alkyd resin | 120 parts by mass |
| 2-butanone | 400 parts by mass |

—Composition of Coating Liquid for Charge Generating Layer—

| | |
|---|---|
| Phthalocyanine pigment expressed by the following structural formula | 19 parts by mass |

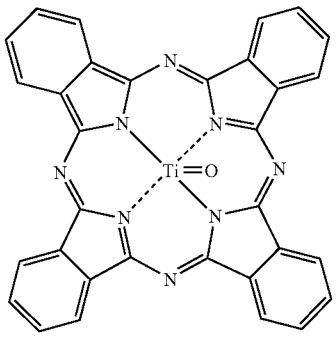

| | |
|---|---|
| Polyvinyl butyral | 13 parts by mass |
| 2-butanone | 1,000 parts by mass |

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

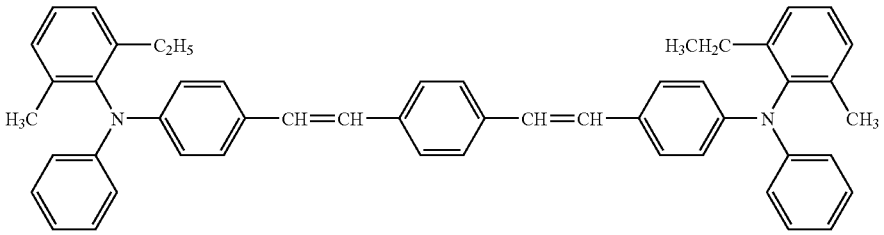

| | |
|---|---|
| Tetrahydrofuran | 100 parts by mass |

Production Example 2

—Production of Photoconductor 2—

"Photoconductor 2" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

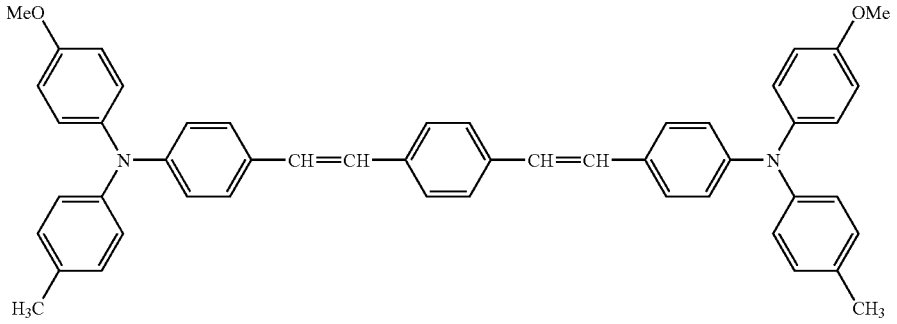

wherein Me represents a methyl group.

| | |
|---|---|
| Tetrahydrofuran | 100 parts by mass |

Production Example 3

—Production of Photoconductor 3—

"Photoconductor 3" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (Teijin Chemicals Ltd.) | 10 parts by mass |
| Charge transporting material expressed by the following structural formula | 7 parts by mass |

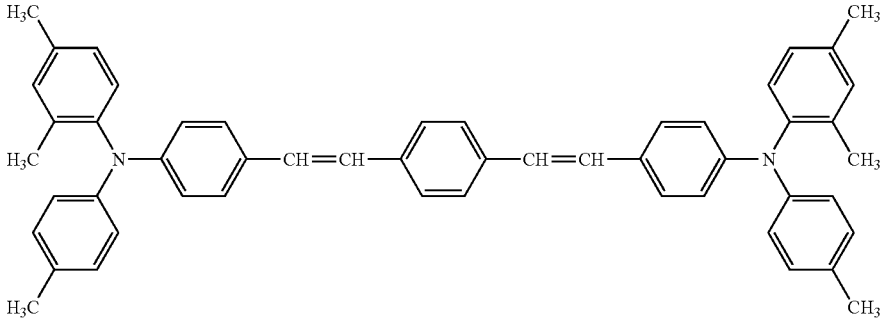

| | |
|---|---|
| Tetrahydrofuran | 100 parts by mass |

—Production of Photoconductor 4—

"Photoconductor 4" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 3 parts by mass |

-continued

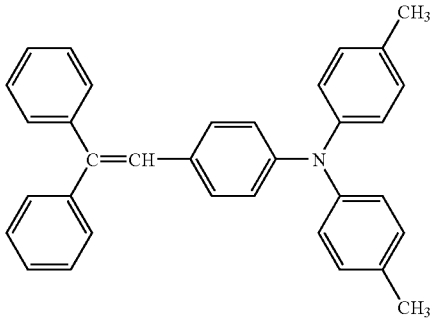

-continued

| | |
|---|---|
| Tetrahydrofuran | 100 parts by mass |

Production Example 5

—Production of Photoconductor 5—

"Photoconductor 5" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

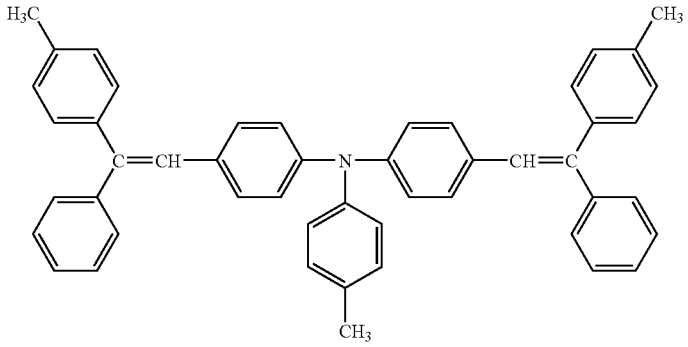

| | |
|---|---|
| Tetrahydrofuran | 100 parts by mass |

Production Example 6

—Production of Photoconductor 6—

"Photoconductor 6" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

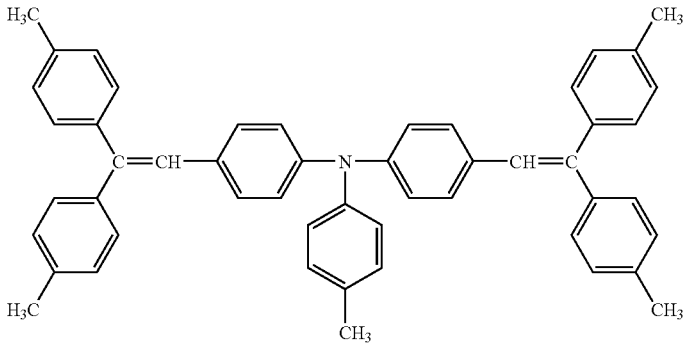

| | |
|---|---|
| Tetrahydrofuran | 100 parts by mass |

Production Example 7

—Production of Photoconductor 7—

"Photoconductor 7" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

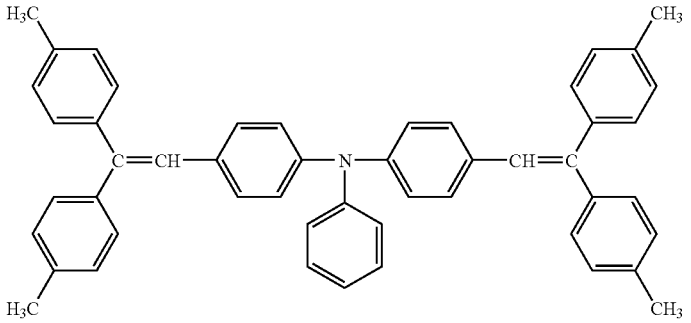

| | |
|---|---|
| Tetrahydrofuran | 100 parts by mass |

Production Example 8

—Production of Photoconductor 8—

"Photoconductor 8" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

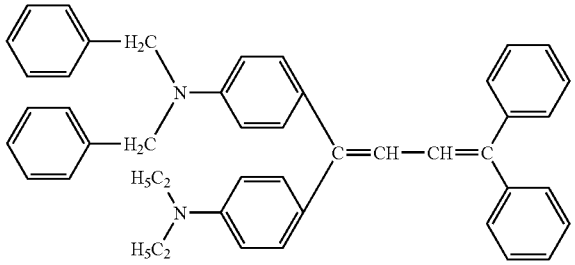

| | |
|---|---|
| Tetrahydrofuran | 100 parts by mass |

Production Example 9

—Production of Photoconductor 9—

"Photoconductor 9" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

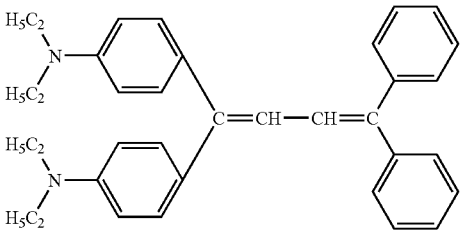

| | |
|---|---|
| Tetrahydrofuran | 100 parts by mass |

—Production of Photoconductor 10—

Production Example 10

"Photoconductor 10" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

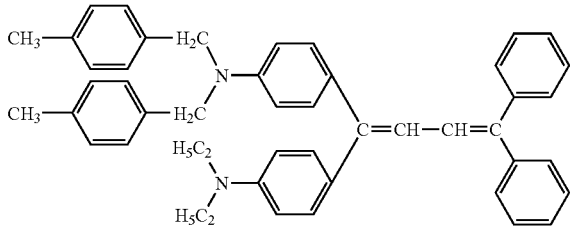

| | |
|---|---|
| Tetrahydrofuran | 100 parts by mass |

Comparative Production Example 1

—Production of Comparative Photoconductor 1—

"Comparative Photoconductor 1" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 7 parts by mass |

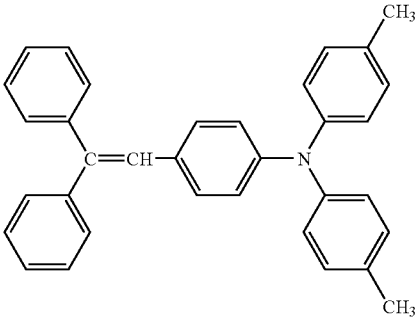

| | |
|---|---|
| Tetrahydrofuran | 100 parts by mass |

Comparative Production Example 2

—Production of Comparative Photoconductor 2—

"Comparative Photoconductor 2" was produced in the same manner as in the Production Example 1, except that the coating liquid for the charge transporting layer in the Production Example 1 was changed to the coating liquid for the charge transporting layer having the following composition.

—Composition of Coating Liquid for Charge Transporting Layer—

| | |
|---|---|
| Bisphenol Z polycarbonate resin TS2050 (by Teijin Chemicals Ltd.) | 10 parts by mass |
| Charge transporting material expressed by the following structural formula | 10 parts by mass |

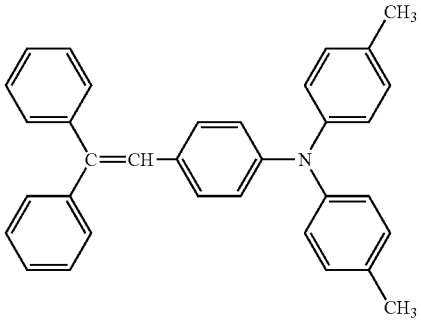

| | |
|---|---|
| Tetrahydrofuran | 100 parts by mass |

Next, the glass transition temperatures of the outermost layers (charge transporting layer) in the produced Photoconductors 1 to 10 and Comparative Photoconductors 1 to 2 were measured as explained below. The result is shown in Table 1.

<Measurement of Glass Transition Temperature>

A coating liquid for the outermost layer was blade coated on an aluminum deposited polyethylene terephthalate (PET) film, and dried under the drying condition similar to that in the production of the photoconductor so as to form a 2 μm-thick coating film. However, when the drying condition in the production of the photoconductor was more than 130° C., the outermost layer was dried at 130° C. for 1 hour. The thus formed coating film was peeled, and about 2 mg of the peeled coating film was weighed in an aluminum sample vessel, and measured using $\alpha$-$Al_2O_3$ as a standard sample by means of Thermo Plus DSC8230 (by Rigaku Denki Co., Ltd.). The sample was heated from a room temperature to 250° C. at a temperature rising rate of 10° C./min to obtain a DSC curve. From the obtained DSC curve, the glass transition temperature of the outermost layer was determined from an intersection of a tangential line of the endothermic curve and the base line.

TABLE 1

| | Glass transition temperature of the outermost layer (° C.) |
|---|---|
| Photoconductor 1 | 130 |
| Photoconductor 2 | 127 |
| Photoconductor 3 | 121 |
| Photoconductor 4 | 111 |
| Photoconductor 5 | 112 |
| Photoconductor 6 | 118 |
| Photoconductor 7 | 119 |
| Photoconductor 8 | 111 |
| Photoconductor 9 | 108 |
| Photoconductor 10 | 110 |
| Comparative Photoconductor 1 | 92 |
| Comparative Photoconductor 2 | 81 |

Production Example 11

—Production of Toner 1—

<Synthesis of Resin Fine Particle Emulsion>

First, 683 parts of water, 11 parts of sodium salt of sulfuric acid ester of ethylene oxide adduct of methacrylic acid (Eleminol RS-30 by Sanyo Chemical Industries, Ltd.), 83 parts of styrene, 83 parts of methacrylic acid, 110 parts of butyl acrylate, and 1 part of ammonium persulfate were put in a reaction vessel equipped with a stirrer and a thermometer, and stirred at 400 rpm for 15 minutes to obtain a white emulsion. The emulsion was heated to a temperature within the system of 75° C. and reacted for 5 hours. Next, 30 parts of 1% water solution of ammonium persulfate was added and matured at 75° C. for 5 hours to obtain an aqueous dispersion liquid of vinyl resin particles (a copolymer of styrene-methacrylic acid-butyl acrylate-sodium salt of sulfuric acid ester of ethylene oxide adduct of methacrylic acid). This was defined as [Fine Particle Dispersion Liquid 1].

A part of the obtained [Fine Particle Dispersion Liquid 1] was dried to isolate a resin content, and the glass transition temperature (Tg) of the resin content was 80° C., which was measured according to the following measurement.

<Measurement of Glass Transition Temperature of Resin Fine Particles>

About 10 mg of a sample was weighed in an aluminum sample vessel, and measured using $\alpha$-$Al_2O_3$ as a standard sample by means of TG-DSC SYSTEM TAS-100 (by Rigaku Denki Co., Ltd.). The sample was heated from a room temperature to 150° C. at a temperature rising rate of 10° C./min. After being left to stand at 150° C. for 10 minutes, the sample was cooled to a room temperature and allowed to leave to stand for 10 minutes. Then, under nitrogen atmosphere, DSC measurement was carried out by heating the sample to 150° C. at a temperature rising rate of 10° C./min to thereby obtain a DSC curve. From the obtained DSC curve, the glass transition temperature of the resin fine particles was determined from an intersection of a tangential line of the endothermic curve and the base line.

<Synthesis of Low-Molecular Polyester>

220 parts of bisphenol A ethylene oxide 2-mole adduct, 561 parts of bisphenol A propylene oxide 3-mole adduct, 218 parts of terephthalic acid, 48 parts of adipic acid and 2 parts of dibutyltin oxide were put in a reaction vessel equipped with a cooling tube, a stirrer and a nitrogen introducing tube and reacted at 230° C. under normal pressure for 8 hours. After being reacted under reduced pressure of 10 mmHg to 15 mmHg for 5 hours, 45 parts of trimellitic anhydride was put in the reaction vessel and reacted at 180° C. under normal pressure for 2 hours to obtain [Low-Molecular Polyester 1].

<Synthesis of Prepolymer>

First, 682 parts of bisphenol A ethylene oxide 2-mole adduct, 81 parts of bisphenol A propylene oxide 2-mole adduct, 283 parts of terephthalic acid, 22 parts of trimellitic anhydride and 2 parts of dibutyltin oxide were put in a reaction vessel equipped with a cooling tube, a stirrer and a nitrogen introducing tube and reacted at 230° C. under normal pressure for 8 hours, and then reacted under reduced pressure of 10 mmHg to 15 mmHg for 5 hours to obtain [Intermediate Polyester 1].

In the obtained [Intermediate Polyester 1], a number average molecular mass was 2,100, a mass average molecular mass was 9,500, a glass transition temperature (Tg) was 55° C., an acid value was 0.5 mgKOH/g and a hydroxyl value was 49 mgKOH/g.

Next, 411 parts of [Intermediate Polyester 1], 89 parts of isophorone diisocyanate and 500 parts of ethyl acetate were put in a reaction vessel equipped with a cooling tube, a stirrer and a nitrogen introducing tube and reacted at 100° C. for 5 hours to obtain [Prepolymer 1].

<Synthesis of Ketimine>

170 parts of isophorone diamine and 75 parts of methyl ethyl ketone were put in a reaction vessel equipped with a stirrer and a thermometer and reacted at 50° C. for 5 hours to obtain [Ketimine Compound 1].

<Preparation of Oil Phase>

First, 628 parts of [Low-Molecular Polyester 1], 110 parts of carnauba wax, 22 parts of a charge controlling agent (CCA: salicylic acid metal complex, E-84 by Orient Chemical Industries, Ltd.) and 947 parts of ethyl acetate were put in a reaction vessel equipped with a stirrer and a thermometer and heated to 80° C. while stirring, and then cooled to 30° C. for 1 hour after retaining at 80° C. for 5 hours. Next, 250 parts of carbon black (REGAL 400R by Cabot Corporation) and 500 parts of ethyl acetate were put in the reaction vessel and mixed for 1 hour to obtain [Raw Material Liquid Solution 1].

Next, 1,324 parts of [Raw Material Liquid Solution 1] was transferred to a reaction vessel and the carbon black and wax therein were dispersed by means of a bead mill Ultra Visco Mill (by Aimex Co., Ltd.) in a condition of solution feeding speed of 1 kg/hr, disc peripheral speed of 6 m/sec., using zirconia beads of 0.5 mm in diameter filled 80% by volume. The dispersing procedure was repeated a total of three times. Next, 1,324 parts of 65% ethyl acetate solution of [Low-Molecular Polyester 1] was added and dispersed under the above condition, except that the dispersion procedure was performed once, to obtain [Pigment and Wax Dispersion Liquid 1].

<Preparation of Oil Phase Compound Liquid>

648 parts of [Pigment and Wax Dispersion Liquid 1], 154 parts of [Prepolymer 1] and 6.6 parts of [Ketimine Compound 1] were put in a reaction vessel and mixed at 5,000 rpm for 1 minute by using a TK HOMOMIXER (by Primix Corp.) to obtain a [Oil Phase Compound Liquid].

<Emulsification and Solvent Removal>

First, 990 parts of water, 80 parts of [Fine Particle Dispersion Liquid 1], 40 parts of 48.5% water solution of sodium dodecyl diphenyl ether disulfonate (Eleminol MON-7 by Sanyo Chemical Industries, Ltd.) and 90 parts of ethyl acetate were put in a reaction vessel and stirred at 3,000 rpm for 1 minute by using a TK HOMOMIXER (by Primix Corp.). 809 parts of [Oil Phase Compound Liquid 1] was then added to the reaction vessel and mixed at a rotation speed of 13,000 rpm for 20 minutes to obtain [Emulsified Slurry 1].

Next, the [Emulsified Slurry 1] was put in a reaction vessel equipped with a stirrer and a thermometer and matured at 45° C. for 4 hours after solvents were removed at 30° C. for 8 hours to obtain [Dispersed Slurry 1].

<Washing and Drying>

After 100 parts of [Emulsified Slurry 1] was filtered under reduced pressure, washing and drying were performed as follows:

(1) 300 parts of ion exchange water was added to a filter cake, and then filtered after mixing at a rotation speed of 12,000 rpm for 10 minutes by means of a TK HOMOMIXER. This procedure was done 3 times to obtain [Filter Cake 1].

(2) The [Filter Cake 1] was dried at 45° C. for 48 hours by using an air circulating dryer and screened with a 75 μm-mesh sieve to obtain toner base particles.

100 parts of the obtained toner base particles, 0.7 parts of hydrophobic silica and 0.3 parts of hydrophobic titanium oxide were mixed by means of a HENSCHEL MIXER to obtain a "Toner 1".

The obtained "Toner 1" had a volume average particle diameter of 5.5 μm, and an average circularity of 0.96.

Production Example 12

—Production of Toner 2—

"Toner 2" was produced in the same manner as in the Production Example 11, except that 11 parts of sodium salt of sulfuric acid ester of ethylene oxide adduct of methacrylic acid (Eleminol RS-30 by Sanyo Chemical Industries, Ltd.), 83 parts of styrene, 83 parts of methacrylic acid, 110 parts of butyl acrylate were respectively changed to 8 parts, 80 parts, 80 parts, and 113 parts in the process for synthesis of resin fine particle emulsion in the method for production of Toner 1 in the Production Example 11.

The obtained "Toner 2" had a volume average particle diameter of 5.6 μm, and a average circularity of 0.95.

In "Toner 2" a glass transition temperature (Tg) of the resin fine particles was 71° C., which was measured in the same manner as in the Toner 1 in the Production Example 11.

Comparative Production Example 3

—Production of Comparative Toner 1—

"Comparative Toner 1" was produced in the same manner as in the Toner 1 in the Production Example 11, except that in the process for synthesis of resin fine particle emulsion in the method for production of the Toner 1 in the Production Example 11, 11 parts of sodium salt of sulfuric acid ester of ethylene oxide adduct of methacrylic acid (Eleminol RS-30 by Sanyo Chemical Industries, Ltd.), 83 parts of styrene, 83 parts of methacrylic acid, 110 parts of butyl acrylate were respectively changed to 8 parts, 79 parts, 79 parts, and 115 parts, and 10 parts of 1,6-hexanediol acrylate was added.

The obtained "Comparative Toner 1" had a volume average particle diameter of 5.5 μm, and an average circularity of 0.96. In the Comparative Toner 1, a glass transition temperature (Tg) of the resin fine particles was 92° C., which was measured in the same manner as in the Toner 1 in the Production Example 11.

Comparative Production Example 4

—Production of Comparative Toner 2—

"Comparative Toner 2" was produced in the same manner as in the Toner 1 in the Production Example 11, except that in the process for synthesis of resin fine particle emulsion in the method for production of the Toner 1 in the Production Example 11, 11 parts of sodium salt of sulfuric acid ester of ethylene oxide adduct of methacrylic acid (Eleminol RS-30 by Sanyo Chemical Industries, Ltd.), 83 parts of styrene, 83 parts of methacrylic acid, 110 parts of butyl acrylate were respectively changed to 8 parts, 70 parts, 70 parts, and 125 parts.

The obtained "Comparative Toner 2" had a volume average particle diameter of 5.4 μm, and an average circularity of 0.96. In the "Comparative Toner 2", a glass transition temperature (Tg) of the resin fine particles was 64° C., which was measured in the same manner as the Toner 1 in the Production Example 11.

Examples 1 to 20 and Comparative Examples 1 to 10

Images were formed by the combination shown in Tables 2 and 3 using each of the obtained photoconductors and toners, and the properties were evaluated as explained below. The results are shown in Tables 2 and 3.

<Evaluation of Toner Transferring Ability>

A halftone solid image having a solid image of 0.3 were continuously printed on 10 sheets by a modified tandem image forming apparatus imagio Neo C455 (by Ricoh Company, Ltd.) in which the obtained photoconductor and toner in the combination shown in Tables 2 and 3 was used. The printing was forcibly stopped while printing the last one. A residual toner on the photoconductor after transferring was peeled by PRINTAC C tape by Nitto Denko Corporation, and attached on a white paper. Its reflection density was measured by means of 939 by X-rite, and evaluated on the basis of the following evaluation criteria. The smaller the value of the reflection density is, the more superior the transferring ability is.

[Evaluation Criteria]

A: Reflection density was less than 0.13

B: Reflection density was 0.13 to less than 0.15

C: Reflection density was 0.15 or more

<Evaluation of High-Temperature Storage Stability of Toner>

Each of the toners was filled in a glass vessel and left to stand in a thermostat at 50° C. for 20 hours. The toner was cooled to a room temperature, and then the depth of penetration of the toner was determined according to the penetration test specified in JIS K 2235-1991, and evaluated on the basis of the following evaluation criteria. With an increasing penetration, the high-temperature storage stability of the toner was rated good.

[Evaluation Criteria]

A: The penetration was 25 mm or more.

B: The penetration was 10 mm or more to less than 25 mm.

C: The penetration was less than 10 mm.

<Evaluation of Low-Temperature Fixing Property>

A copy test was performed using a modified tandem image forming apparatus imagio Neo C455 (by Ricoh Company Ltd.) equipped with a belt fixing unit shown in FIG. 3 in which a recording medium Type 6200 (by Ricoh Company Ltd.) was set. The lowest fixing temperature (° C.) was defined by a temperature of the fixing roller at which a survival rate of the image density was 70% or more after rubbing the fixed image with a pat. The low-temperature fixing property was evaluated on the basis of the following evaluation criteria.

[Evaluation Criteria]

A: Temperature of the fixing roller was 120° C. or less.

B: Temperature of the fixing roller was 121° C. to less than 140° C.

C: Temperature of the fixing roller was 140° C. or more.

TABLE 2

| | Photoconductor | | Toner | | | | |
|---|---|---|---|---|---|---|---|
| | Photoconductor No. | Glass transition temperature of the outermost layer | Toner No. | Glass transition temperature of the resin fine particles | High temperature storage stability | Low-temperature image-fixing property | Evaluation of transferring ability (Reflection density) |
| Example 1 | Photoconductor 1 | 130° C. | Toner 1 | 80° C. | A(27 mm) | A(120° C.) | A(0.124) |
| Example 2 | Photoconductor 2 | 127° C. | Toner 1 | | | | A(0.122) |
| Example 3 | Photoconductor 3 | 121° C. | Toner 1 | | | | A(0.120) |
| Example 4 | Photoconductor 4 | 111° C. | Toner 1 | | | | A(0.119) |
| Example 5 | Photoconductor 5 | 112° C. | Toner 1 | | | | A(0.120) |
| Example 6 | Photoconductor 6 | 118° C. | Toner 1 | | | | A(0.121) |
| Example 7 | Photoconductor 7 | 119° C. | Toner 1 | | | | A(0.119) |
| Example 8 | Photoconductor 8 | 111° C. | Toner 1 | | | | A(0.120) |
| Example 9 | Photoconductor 9 | 108° C. | Toner 1 | | | | A(0.119) |
| Example 10 | Photoconductor 10 | 110° C. | Toner 1 | | | | A(0.120) |
| Example 11 | Photoconductor 1 | 130° C. | Toner 2 | 71° C. | A(25 mm) | A(110° C.) | A(0.110) |
| Example 12 | Photoconductor 2 | 127° C. | Toner 2 | | | | A(0.120) |
| Example 13 | Photoconductor 3 | 121° C. | Toner 2 | | | | A(0.126) |
| Example 14 | Photoconductor 4 | 111° C. | Toner 2 | | | | A(0.121) |
| Example 15 | Photoconductor 5 | 112° C. | Toner 2 | | | | A(0.120) |
| Example 16 | Photoconductor 6 | 118° C. | Toner 2 | | | | A(0.122) |
| Example 17 | Photoconductor 7 | 119° C. | Toner 2 | | | | A(0.120) |
| Example 18 | Photoconductor 8 | 111° C. | Toner 2 | | | | A(0.124) |
| Example 19 | Photoconductor 9 | 108° C. | Toner 2 | | | | A(0.125) |
| Example 20 | Photoconductor 10 | 110° C. | Toner 2 | | | | A(0.123) |

TABLE 3

| | Photoconductor | | Toner | | | | |
|---|---|---|---|---|---|---|---|
| | Photoconductor No. | Glass transition temperature of the outermost layer | Toner No. | Glass transition temperature of the resin fine particles | High temperature storage stability | Low-temperature image-fixing property | Evaluation of transferring ability (Reflection density) |
| Comparative Example 1 | Photoconductor 1 | 130° C. | Comparative Toner 1 | 92° C. | A(31 mm) | C(145° C.) | B(0.140) |
| Comparative Example 2 | Photoconductor 4 | 111° C. | Comparative Toner 1 | | | | B(0.145) |
| Comparative Example 3 | Photoconductor 6 | 118° C. | Comparative Toner 1 | | | | B(0.147) |
| Comparative Example 4 | Photoconductor 9 | 108° C. | Comparative Toner 1 | | | | B(0.147) |
| Comparative Example 5 | Comparative Photoconductor 1 | 92° C. | Comparative Toner 1 | | | | C(0.153) |
| Comparative Example 6 | Comparative Photoconductor 2 | 81° C. | Comparative Toner 1 | | | | C(0.216) |
| Comparative Example 7 | Photoconductor 1 | 130° C. | Comparative Toner 2 | 64° C. | C(6 mm) | A(100° C.) | C(0.156) |
| Comparative Example 8 | Photoconductor 4 | 111° C. | Comparative Toner 2 | | | | C(0.160) |
| Comparative Example 9 | Photoconductor 6 | 118° C. | Comparative Toner 2 | | | | C(0.161) |
| Comparative Example 10 | Photoconductor 9 | 108° C. | Comparative Toner 2 | | | | C(0.163) |

As can be seen from the result of Tables 2 and 3, the combination of the toner containing the resin fine particles having the glass transition temperature of 65° C. to 85° C., and the electrophotographic photoconductor containing the outermost layer having the glass transition temperature of 100° C. or more in Examples 1 to 20 could obtain the lower reflection density in the evaluation of the transferring ability, and the superior toner transferring ability compared to those in Comparative Examples 1 to 10.

According to the image forming apparatus and image forming method of the present invention, the excellent toner transferring ability can be obtained, thus the residual toner after transferring, which is a cause for fog, can be significantly reduced, and the high quality image can be formed without causing fog even after long term use. Thus, the image forming apparatus and image forming method of the present invention can be widely used for a full-color copier, a full-color laser printer, a full-color plain paper facsimile and the like using a direct or indirect electrophotographic multicolor image developing system.

What is claimed is:

1. An image forming apparatus comprising:

an electrophotographic photoconductor, a latent electrostatic image forming unit configured to form a latent electrostatic image on the electrophotographic photoconductor, a developing unit configured to develop the latent electrostatic image using a toner to form a visible image, a transferring unit configured to transfer the visible image to a recording medium, and a fixing unit configured to fix the transferred image on the recording medium, wherein a glass transition temperature of an outermost layer of the electrophotographic photoconductor is 100° C. or more, wherein the toner is obtained by:

at least one of dissolving and dispersing the toner material comprising an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein a glass transition temperature of the resin fine particles is 65° C. to 85° C., and wherein the outermost layer of the electrophotographic photoconductor comprises a compound s represented by the following formula:

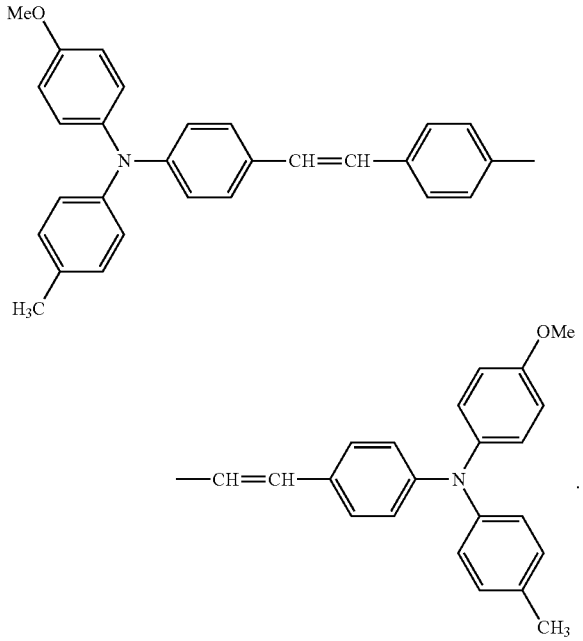

2. The image forming apparatus according to claim 1, wherein the outermost layer of the electrophotographic photoconductor further comprises a compound expressed by the Structural Formula (3):

Structural Formula (3)

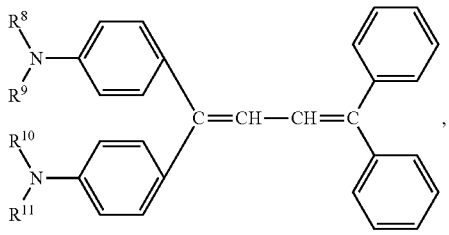

wherein, $R^8$ to $R^{11}$ may be identical to each other or different, and represent an alkyl group which may have an aryl group as a substituent.

3. The image forming apparatus according to claim 1, wherein the electrophotographic photoconductor comprises a substrate, and at least a charge generating layer and a charge transporting layer disposed in this order on the substrate, and the charge transporting layer is the outermost layer.

4. The image forming apparatus according to claim 1, wherein a process cartridge is detachably attached to the image forming apparatus, wherein the process cartridge comprises the electrophotographic photoconductor, and the developing unit configured to develop the latent electrostatic image formed on the electrophotographic photoconductor using the toner to form the visible image.

5. An image forming method comprises:

forming a latent electrostatic image on an electrophotographic photoconductor, developing the latent electrostatic image using a toner to form a visible image, transferring the visible image to a recording medium, and fixing the transferred image on the recording medium, wherein a glass transition temperature of an outermost layer of the electrophotographic photoconductor is 100° C. or more, wherein the toner is obtained by:

at least one of dissolving and dispersing the toner material comprising an active hydrogen group-containing compound and a polymer that is reactive with the active hydrogen group-containing compound in an organic solvent to form a solution or dispersion, at least one of emulsifying and dispersing the solution or dispersion in an aqueous medium containing resin fine particles, allowing the active hydrogen group-containing compound and the polymer that is reactive with the active hydrogen group-containing compound to react in the aqueous medium, and removing the organic solvent, wherein a glass transition temperature of the resin fine particles is 65° C. to 85° C., and wherein the outermost layer of the electrophotographic photoconductor comprises a compound s represented by the following formula:

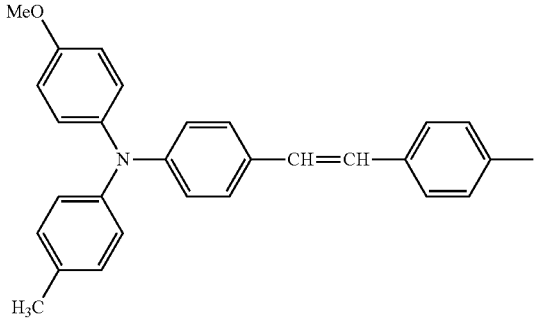

-continued

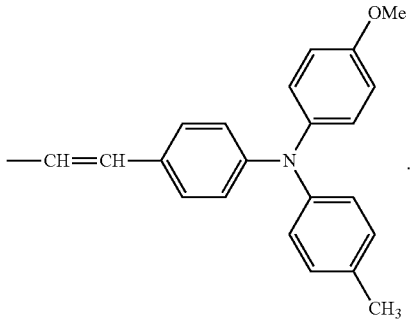

6. The image forming method according to claim 5, wherein the outermost layer of the electrophotographic photoconductor further comprises a compound expressed by the Structural Formula (3):

Structural Formula (3)

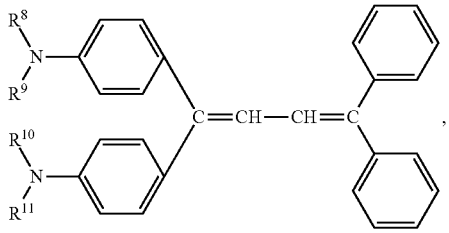

wherein, $R^8$ to $R^{11}$ may be identical to each other or different, and represent an alkyl group which may have an aryl group as a substituent.

7. The image forming method according to claim 5, wherein the electrophotographic photoconductor comprises a substrate, and at least a charge generating layer and a charge transporting layer disposed in this order on the substrate, and the charge transporting layer is the outermost layer.

* * * * *